US011226170B2

(12) United States Patent
Lynch

(10) Patent No.: US 11,226,170 B2
(45) Date of Patent: Jan. 18, 2022

(54) TAKEDOWN STOCK FOR A PISTOL-CALIBER CARBINE

(71) Applicant: Magpul Industries Corp., Austin, TX (US)

(72) Inventor: Clinton Wade Lynch, Erie, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 17/096,302

(22) Filed: Nov. 12, 2020

(65) Prior Publication Data

US 2021/0140738 A1 May 13, 2021

Related U.S. Application Data

(60) Provisional application No. 62/934,404, filed on Nov. 12, 2019.

(51) Int. Cl.
*F41C 23/22* (2006.01)

(52) U.S. Cl.
CPC ..... *F41C 23/22* (2013.01)

(58) Field of Classification Search
CPC ..... F41A 11/04; F41A 11/00; F41C 23/22
See application file for complete search history.

(56) References Cited

U.S. PATENT DOCUMENTS 521,202 A 6/1894 Burgess
570,145 A 10/1896 Pittavino
652,583 A 6/1900 Baird
711,989 A 10/1902 Marble
856,016 A 6/1907 Balson
894,101 A 7/1908 Balson
(Continued)

FOREIGN PATENT DOCUMENTS

DE 102009051416 A1 7/2010
EP 0216015 A1 4/1987
(Continued)

OTHER PUBLICATIONS

Byczko, Rafal, "Office Action Regarding Canadian Patent Application No. 2987591", dated Dec. 6, 2018, p. 3, Published in: CA.
(Continued)

*Primary Examiner* — J. Woodrow Eldred
(74) *Attorney, Agent, or Firm* — Neugeboren O'Dowd PC

(57) ABSTRACT

A takedown firearm stock and related methods are disclosed. The takedown firearm stock has a buttstock assembly comprising a magazine release; a first accessory mounting interface; a forend assembly comprising a recess for receiving a barrel having a barrel shank, and a release mechanism for removably coupling the forend assembly and the buttstock assembly, and one of: an attachment bracket or a barrel tray configured to support the barrel, the attachment bracket or the barrel tray comprising the first accessory mounting interface. When the forend assembly is coupled to the buttstock assembly in a deployed configuration, the forend assembly releasably couples to the buttstock assembly at a forend-to-stock interface, and when the forend assembly is coupled to the buttstock assembly in a stowed configuration, the forend assembly releasably couples to an underside of the buttstock assembly.

20 Claims, 20 Drawing Sheets

(56) References Cited

U.S. PATENT DOCUMENTS

| | | | |
|---|---|---|---|
| 931,328 | A | 8/1909 | Marble |
| 1,083,384 | A | 1/1914 | Browning |
| 1,150,763 | A | 8/1915 | High |
| 1,370,118 | A | 3/1921 | Johnson |
| 1,517,420 | A | 12/1924 | Lewis |
| 1,779,770 | A | 10/1930 | Harrington |
| 2,298,678 | A | 10/1942 | Chase |
| 2,345,083 | A | 3/1944 | Williams |
| 2,476,355 | A | 7/1949 | Brown |
| 2,495,977 | A | 1/1950 | Madsen |
| 2,852,880 | A | 11/1955 | Kauffman |
| 3,123,928 | A | 3/1964 | Lizza |
| 3,267,600 | A | 8/1966 | Ryan |
| 3,618,248 | A | 11/1971 | Into et al. |
| 3,618,249 | A | 11/1971 | Grandy |
| 3,638,344 | A | 2/1972 | Wagner et al. |
| 3,641,694 | A | 2/1972 | Seidel et al. |
| 4,299,046 | A | 11/1981 | Atchisson |
| 4,426,910 | A | 1/1984 | Speer |
| 4,625,621 | A | 12/1986 | Warin |
| 5,048,213 | A | 9/1991 | Gerhard |
| 5,225,613 | A | 7/1993 | Claridge |
| 5,351,428 | A | 10/1994 | Graham |
| 5,924,233 | A | 7/1999 | Strobel |
| 5,933,998 | A | 8/1999 | Plebani |
| 5,987,797 | A | 11/1999 | Dustin |
| 6,470,617 | B1 | 10/2002 | Gregory et al. |
| 6,539,659 | B2 | 4/2003 | Salva |
| 6,874,266 | B1 | 4/2005 | Kong |
| 6,889,463 | B2 | 5/2005 | Orth |
| 7,104,000 | B2 | 9/2006 | Orth |
| 7,503,137 | B2 | 3/2009 | Filicietti |
| 7,644,528 | B2 | 1/2010 | Wossner et al. |
| 7,805,873 | B2 | 10/2010 | Bentley |
| 7,841,121 | B1 | 11/2010 | Barrett |
| 7,861,451 | B1 | 1/2011 | Moody et al. |
| 7,937,873 | B2 | 5/2011 | Keng |
| 8,069,600 | B2 | 12/2011 | Rousseau et al. |
| 8,079,169 | B2 | 12/2011 | Gregg |
| 8,312,661 | B2 | 11/2012 | Ludlow |
| D681,148 | S | 4/2013 | Wilkinson |
| 8,689,478 | B2 | 4/2014 | Patel |
| 8,782,941 | B2 | 7/2014 | Zusman |
| 8,943,728 | B2 | 2/2015 | Ward et al. |
| 9,010,004 | B1 | 4/2015 | Fu |
| 9,021,734 | B2 | 5/2015 | Voigt |
| 9,188,399 | B1 | 11/2015 | Findlay et al. |
| 9,739,563 | B1 | 8/2017 | Tharp |
| 10,132,584 | B2 | 11/2018 | Abbott et al. |
| 10,161,699 | B2 | 12/2018 | Sessions et al. |
| 10,161,713 | B1 | 12/2018 | Goldense |
| 10,203,178 | B2 | 2/2019 | Drake |
| 10,228,205 | B2 | 3/2019 | Quinn et al. |
| 2008/0190004 | A1 | 8/2008 | Filicietti |
| 2009/0277066 | A1 | 11/2009 | Burt et al. |
| 2010/0281742 | A1 | 11/2010 | Barrett |
| 2011/0072705 | A1 | 3/2011 | Simpkins |
| 2011/0099872 | A1 | 5/2011 | Bentley et al. |
| 2011/0239514 | A1 | 10/2011 | Godard |
| 2013/0139424 | A1 | 6/2013 | Devine |
| 2013/0212920 | A1 | 8/2013 | Law |
| 2014/0075802 | A1 | 3/2014 | Dubois et al. |
| 2014/0352190 | A1 | 12/2014 | Voigt |
| 2015/0184957 | A1 | 7/2015 | Guerini |
| 2015/0276343 | A1 | 10/2015 | Zusman |
| 2016/0084612 | A1 | 3/2016 | Robinson et al. |
| 2016/0377361 | A1 | 12/2016 | Osborne |
| 2017/0205186 | A1 | 7/2017 | Kjellberg |
| 2018/0017346 | A1 | 1/2018 | Jones |
| 2018/0058802 | A1 | 3/2018 | Hall |
| 2018/0156555 | A1 | 6/2018 | Sessions et al. |
| 2018/0224233 | A1 | 8/2018 | Macy |
| 2018/0231348 | A1 | 8/2018 | Whelan |
| 2019/0025012 | A1 | 1/2019 | Hall |
| 2019/0212095 | A1 | 7/2019 | Ballard |
| 2019/0323790 | A1 | 10/2019 | Ballard |
| 2019/0346231 | A1 | 11/2019 | Ma et al. |
| 2021/0140738 | A1* | 5/2021 | Lynch ..... F41C 23/22 |

FOREIGN PATENT DOCUMENTS

| | | | |
|---|---|---|---|
| EP | 0862040 | A2 | 9/1998 |
| GB | 298964 | A | 10/1928 |
| WO | 2001022023 | A1 | 3/2001 |
| WO | 2008097308 | A2 | 8/2008 |

OTHER PUBLICATIONS

Borden Ladner Gervais LLP, "Response to Office Action Regarding Canadian Patent Application No. 2987591", dated Dec. 14, 2018, p. 7, Published in: CA.

Morgan, Derrick, "Office Action Regarding U.S. Appl. No. 16/193,017", dated Jul. 25, 2019, p. 35, Published in: US.

Gruber, Stephen, "Response to Office Action Regarding U.S. Appl. No. 16/193,017", dated Oct. 16, 2019, p. 11, Published in: US.

Eger, Chris, "4 Foldable Submachine Guns", Feb. 8, 2013, p. 9, Retrieved from http://www.guns.com/2013/02/08/foldable-submachine-guns/.

Adaptive Tactical, "ADTAC RM4 Rear Stock", Known to exist as early as Sep. 26, 2016, p. 2, Retrieved from https://adaptivetactical.com/products/adtac-rm4-replacement-ras.

Cheaper Than Dirt!, "Ruger Stock", Known to exist as early as Sep. 22, 2016, p. 1, Retrieved from http://blog.cheaperthandirt.com/wp-content/uploads/2013/01/IMG_93661.jpg.

Chiappa Firearms, "Chiappa M6 Folding Shotgun/Rifle", Known to exist as early as Feb. 9, 2016, p. 21, Retrieved from https://www.chiappafirearms.com/p.php?id=213.

Kel Tec Weapons, "The SU-22 Series", Known to exist as early as Sep. 22, 2016, p. 2, Publisher: Retrieved from https://www.keltecweapons.com/rifles/su-22ca.

Kel Tec, "SU16", Known to exist as early as Sep. 22, 2016, p. 1, Retrieved from http://siarsenal.com/wp-content/uploads/2015/11/KelTecSU16_2.jpg.

Kel Tec Weapons, "The SUB-2000", Known to exist as early as Feb. 9, 2016, p. 3, Retrieved from https://www.keltecweapons.com/rifles/sub-2000.

Magpul Industries, Inc., "Magpul FMG9 (Folding Machine Gun) Featured on Discovery Channel's Ultimate Weapons", Aug. 26, 2009, p. 8, Retrieved from https://www.youtube.com/watch?v=pY2EqFzPzn8.

Marlin Firearms, "Model 70PSS (Take Down)", Known to exist as early as Feb. 9, 2016, p. 2, Retrieved from https://www.mariinfirearms.com/rimfire/model-795/model-70pss-take-down.

Nemesis Arms, Inc., "Vanquish Multi-Caliber", Known to exist as early as Feb. 9, 2016, p. 1,Retrieved from http://www.nemesisarms.com/nemesis_vanquish.html.

Magpul Industries, Corp., "PC Backpacker Stock-Ruger PC Carbine", Known to exist as early as Jan. 17, 2020, Retrieved from https://magpul.com/ruger-pc-carbine-backpacker-stock.html on Jan. 29, 2020.

Eger, Chris, "Remington Model 8: Brownings Semi-Auto Sporting Rifle", Sep. 30, 2015, p. 5, Retrieved from http://www.guns.com/2015/09/30/remington-model-8-browning-semi-automatic-sporting-rifle/.

User FF162162BFD, "Rguns SMS Stock", Known to exist as early as Sep. 22, 2016, p. 3, Retrieved from http://photobucket.com/gallery/user/ff162162bfd/media/cGF0aDovUkdVTIMtU01TLVN0b2NrLmpwZw==/?ref=.

Sturm, Ruger & Co., Inc., "PC Carbine", Known to exist as early as Sep. 13, 2019, p. 4, Publisher: https://ruger.com/products/pcCarbine/models.html.

Church, A.K., "Springfield Armory M-6 Scout Survival Gun", Aug. 6, 2003, p. 15, Retrieved from http://www.milesfortis.us/church/akc13.htm.

The Arms Room, LLC, "Achieve Tactical Superiority", Known to exist as early as Feb. 9, 2016, p. 3, Retrieved from http://www.thearmsroom.com/id3.html.

(56) References Cited

OTHER PUBLICATIONS

Henry Repeating Arms, "U.S. Survival AR-7", Known to exist as early as Feb. 9, 2016, p. 5, Retrieved from https://www.henryusa.com/rifles/u-s-survival-ar-7/.

Magpul Industries Corp., "X-22 Backpacker Stock—Ruger 10/22 Takedown", Known to exist as early as Jan. 10, 2017, p. 4, Retrieved from https://magpul.com/hunterx-22backpackerstock-ruger10-22takedown.html?mp_global_color=118 on Jan. 29, 2020.

* cited by examiner

TAKEDOWN STOCK FOR A PISTOL-CALIBER CARBINE

CLAIM OF PRIORITY UNDER 35 U.S.C § 119

The present application for patent claims priority to Provisional Application No. 62/934,404 entitled "Takedown Firearm with Integral Forend Storage" filed Nov. 12, 2019, and assigned to the assignee hereof and hereby expressly incorporated by reference herein

FIELD OF THE DISCLOSURE

The present disclosure relates generally to firearms. In particular, but not by way of limitation, the present disclosure relates to systems, methods and apparatuses for a takedown rifle.

DESCRIPTION OF RELATED ART

Handguns have long been the weapon of choice when space is at a minimum. However, handguns do not compare in accuracy and ease of long-range shooting to rifles and carbines. Over the years, many have devised various breakdown rifles and carbines that can be stowed in backpacks or small carrying cases. However, these folding breakdown rifles suffer from one or more deficiencies including lower precision due to the lack of a forend or handguard, susceptibility to damage, inadequate storage space or accessory mounting systems, and cumbersome magazine release mechanisms.

SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below. For the purposes of this disclosure, the terms "buttstock assembly" and "stock assembly" may be used interchangeably throughout this application.

There remains a need for a lightweight takedown firearm stock that provides a user with the ability to securely attach an accessory to a forward region of the firearm. Further, there is a need for a refined magazine release button which alleviates the deficiencies of existing designs.

The current disclosure aims to alleviate some of the problems associated with folding breakdown firearms and existing mounting systems for attaching various types of accessories to firearms. Existing folding breakdown firearms (e.g., M4 Survival Rifle, M6 Aircrew Survival Weapon, ArmaLite AR-7, Kel-Tec SUB-2000, and Kel-Tec SU-16) suffer some disadvantages. For instance, some rifles lack a forend or handguard, making them not only less suitable for high precision applications due to inconsistent barrel harmonics, but also less comfortable for use during long strings of fire such as during training (i.e., due to heat generated from firing). In some cases, this issue is exacerbated as caliber size increases, since larger rounds transfer more heat to the barrel. Additionally, grasping a barrel directly can affect barrel harmonics and potentially reduce accuracy.

In some other cases, folding breakdown firearms (e.g., the Kel-Tec SUB-2000 and Kel-Tec SU-16) typically fold at an axis near a rear of the receiver and consequently leave the muzzle of the firearm exposed and susceptible to damage, especially if carried in a backpack or other non-traditional carrying case. Others, like the Ruger SR-556 Takedown, or Remington/Bushmaster ACR are stored in separate pieces, making stowage and transport more complicated than folding-style weapons. Some, such as the US Survival Rifle variation of the AR-7, stow multiple pieces of the firearm in the stock, and while this protects the components and provides a single small package for carry, it also means that the firearm is separated into a greater number of pieces to facilitate such compact storage. Further, many of these designs are limited to .22 caliber or smaller caliber rimfire firearms. What is more, most of these breakdown weapons are custom designs and thus their features and function are specific to that individual design and are not easily implemented across a broad range of weapons.

Many of these breakdown weapons also attempt to use space in the stock to store extra ammunition or magazines. However, these attempts often leave the ammunition or magazines at least partially exposed and more prone to impact and moisture (e.g., Kel-Tec SU-16 and the ADTAK RM-4). Others arrange magazines or cartridges longitudinally through a rear of the buttstock, but this means that only a single magazine or cartridge can be accessed at a time, and a complex reshuffling is required to use a second or third magazine or cartridge.

Besides a need for a more compact configuration, users of long-range rifles often have a desire to attach accessories to them. There are several places on a rifle upon which accessories may be mounted, but some are most usefully mounted along the sides and bottom of the forend. Such accessories include slings, bipods, lights, alternate grips, lasers and other useful accessories.

Existing mounting systems are often designed to securely fasten accessories to the firearm and provide a very low tolerance for movement, especially during firing. Such systems often work best with heavy, durable materials, such as steel, to keep movement tolerances low. However, it may be undesirable to use dense materials in some areas of a firearm, such as an entire stock or buttstock, because such materials may increase the overall weight of the firearm. For instance, a forend formed from steel would have a large moment arm for an upright shooter and make holding the barrel on target exhausting.

Lastly, in some cases, firearms include mechanisms for magazine replacement, through the use of a button or a release. A user may depress a button or other selector to release the magazine from the magazine well. Such a button typically passes through an aperture in the receiver. Furthermore, current magazine release buttons often include a screw arranged perpendicular to the barrel for holding the button within the magazine release mechanism, which may be aesthetically displeasing to some users.

Broadly, aspects of the current disclosure relate to a lightweight takedown firearm stock that provides a user with the ability to securely attach an accessory to a forward region of the firearm. The takedown firearm stock may also provide a magazine release button that can be prevented from inadvertently rotating (e.g., via a keying structure), which may serve to enhance the user's efficiency.

Some embodiments of the disclosure may be characterized as a takedown firearm stock, comprising: a buttstock assembly comprising a magazine release; a first accessory mounting interface; a forend assembly comprising a recess for receiving a barrel having a barrel shank, and wherein the forend assembly further comprises: a release mechanism for removably coupling the forend assembly and the buttstock assembly, and one of: an attachment bracket configured to support the barrel, the attachment bracket comprising the first accessory mounting interface, or a barrel tray removably coupled to the forend assembly, the barrel tray comprising a barrel channel configured to receive and interface with the barrel, wherein the barrel channel is unitary with or coupled to the first accessory mounting interface; wherein when the forend assembly is coupled to the buttstock assembly in a deployed configuration, the forend assembly releasably couples to the buttstock assembly at a forend-to-stock interface, and the barrel shank couples to a receiver of the takedown firearm, and when the forend assembly is coupled to the buttstock assembly in a stowed configuration, the forend assembly releasably couples to an underside of the buttstock assembly.

Other embodiments of the disclosure may be characterized as a method, comprising: providing a buttstock assembly, and a forend assembly for a takedown firearm, wherein the forend assembly is removably couplable to the buttstock assembly in a deployed configuration and a stowed configuration; providing a release mechanism for removably coupling the forend assembly and the buttstock assembly, the release mechanism comprising a release button and a detent engagement, the release button configured to release the detent engagement when depressed; providing a recess and a barrel tray in the forend assembly for receiving a barrel having a barrel shank, wherein the barrel tray is configured to interface with the barrel; providing a first accessory mounting interface unitary with or coupled to the barrel tray; providing a magazine release having a keying feature, and at least one button, wherein the at least one button is configured to enable release of a magazine from a magazine well of the takedown firearm when depressed; coupling the forend assembly to the buttstock assembly in the deployed configuration, the barrel shank of the barrel configured to couple to a receiver of the takedown firearm; and coupling the forend assembly to the buttstock assembly in the stowed configuration, wherein the forend assembly is coupled to an underside of the buttstock assembly.

Yet other embodiments of the disclosure may be characterized as a takedown firearm, comprising: an action assembly; a barrel having a barrel shank; a magazine release; a buttstock assembly; a first accessory mounting interface; a forend assembly comprising a recess for receiving the barrel, and wherein the forend assembly further comprises: a release mechanism for removably coupling the forend assembly and the buttstock assembly, and one of: an attachment bracket configured to support the barrel, the attachment bracket comprising the first accessory mounting interface, or a barrel tray removably coupled to the forend assembly, the barrel tray comprising a barrel channel configured to receive and interface with the barrel, wherein the barrel channel is unitary with or coupled to the first accessory mounting interface; wherein when the forend assembly is coupled to the buttstock assembly in a deployed configuration, the forend assembly releasably couples to the buttstock assembly at a forend-to-stock interface, and the barrel shank is configured to couple to the action assembly, and when the forend assembly is coupled to the buttstock assembly in a stowed configuration, the forend assembly releasably couples to an underside of the buttstock assembly.

Further embodiments of the disclosure may be characterized as a magazine release comprising a first button, a shaft coupled to the first button, a fastener, and optionally a second button. The first button can be configured to enable release of a magazine from a magazine well of a receiver. The shaft can comprise a notch configured to interface with a tab within the receiver for selective release of a magazine via movement of the shaft along a longitudinal axis of the shaft through the receiver. The fastener can be arranged perpendicular to the shaft and passing through the first button and an end of the shaft to secure the first button to the shaft. In some cases, there may not be a fastener or fastener opening in a face of the first button. In some cases, the fastener is a set screw, snap pin, rivet, push pin, or spring pin. In other cases, the first button is configured for installation within a cutout in the receiver such that the fastener is not visible once the magazine release is installed in the receiver. In yet other cases, the end of the shaft is keyed to prevent rotation of the first button relative to the shaft. The end can have a rectangular profile. In some instances, the first button can include a recess shaped to accept the rectangular profile. The fastener can pass through the recess of the first button and the end of the shaft. The shaft can have a mostly circular cross section with a flat edge. A second button can be coupled to the shaft on an opposing end to the first button.

DETAILED DESCRIPTION

Figure 1:
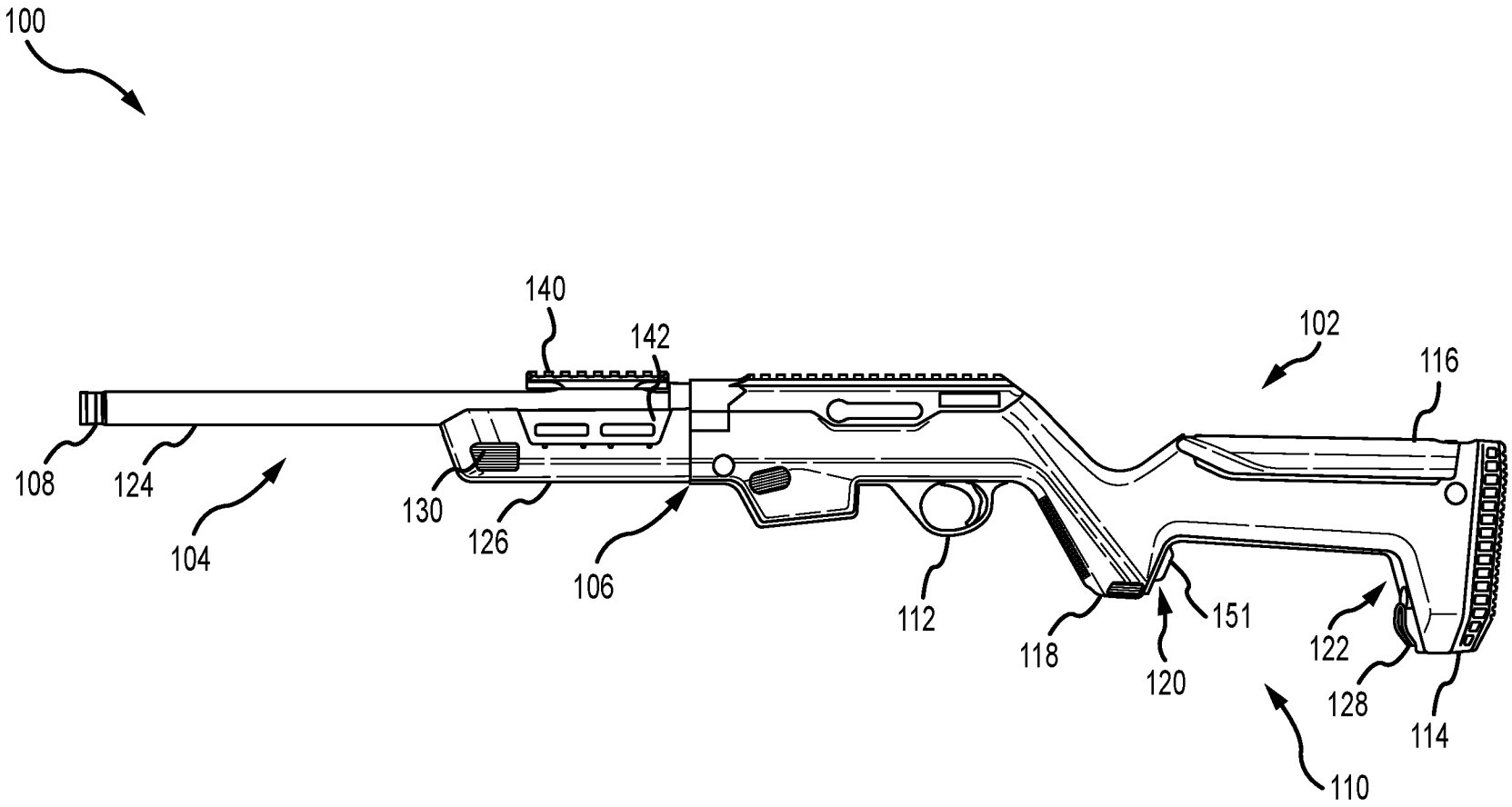
FIG. 1 is a side view of a takedown firearm and buttstock assembly in a deployed configuration.

Co-owned U.S. patents with U.S. Pat. Nos. 10,161,699 and 10,551,138 for a takedown firearm with integral forend storage and U.S. Pat. No. 10,345,076 for a firearm barrel tray, stock, and related methods are incorporated herein by reference.

To overcome the challenges of breakdown rifles/carbines in the prior art, the present disclosure presents a breakdown or "backpacker" rifle comprising a takedown firearm stock. The takedown firearm stock comprises a buttstock assembly 102 (also referred to as a stock assembly) and a forend assembly 104. The illustrated firearm 100 can be fired when in a deployed configuration (see FIG. 1), can be separated at a forend-to-stock interface 106, and the forend assembly 104 can be releasably coupled to an underside of the buttstock assembly 102 to ease carrying of the firearm 100 and protect a muzzle 108 and barrel shank 134 when the firearm 100 is in a stowed configuration. In some cases, the buttstock assembly may have an aperture for receiving the barrel shank 134 and a passage for supporting the barrel, further described below.

The buttstock assembly 102 can include a forend assembly storage cavity 110 (compare FIG. 1 and FIG. 2), an action assembly 112, a buttpad 114 (also referred to as a recoil or shoulder pad), one or more cheek pieces 116, and a grip 118. In some examples, the forend assembly storage cavity 110 can include a fore portion 120 and an aft region 122, where the forend assembly storage cavity 110 may be arranged between the buttpad 114 and the grip 118 and below the cheek piece 116, as illustrated in FIGS. 2 and 3.

Figure 5:
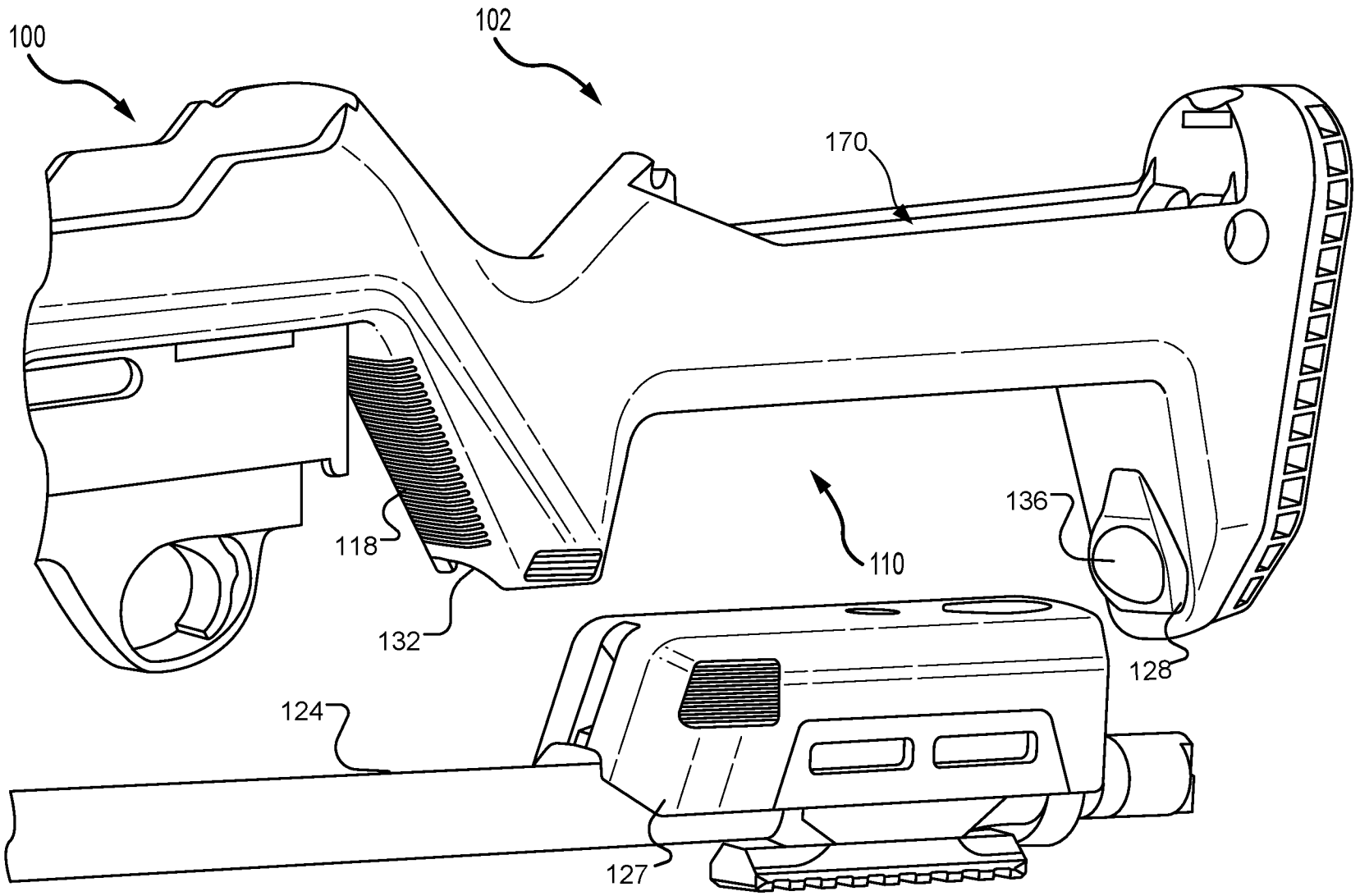
FIG. 5 is an exploded side view of the forend assembly and the buttstock assembly.

The action assembly 112 may be removable from the buttstock assembly 102, and can include a trigger assembly, receiver, and bolt among other components. The action assembly 112 may be configured for use with 9 mm rounds, although other calibers and round types can also be implemented with the buttstock assembly 102. The cheek piece 116 may provide a protective and optionally sealed (e.g., water-tight) covering for a stock storage compartment 170, as seen in FIG. 5.

The forend assembly 104 can include a barrel 124 and forend 126, the barrel 124 having a muzzle 108 at a firing end of the barrel 124. The forend assembly storage cavity 110 may be shaped to accept the forend 126 of the forend assembly 104 when the firearm 100 is in the stowed configuration, where the forend 126 may be on top of the barrel 124 (i.e., where the forend 126 and barrel 124 are inverted), as seen in FIGS. 2 and 5. FIG. 3 illustrates a side view of the takedown firearm and buttstock assembly in FIG. 2, where an outer surface (i.e., a forend shell) of the forend 126 has been removed. Thus, only the inside of the forend 126 is visible in FIG. 3. In the deployed configuration, the forend 126 can be defined as a structure under and indirectly supporting the barrel 124 and forward of the buttstock assembly 102. The barrel 124 may be implemented with a variety of barrel lengths including those between 16" and 18.5" or greater than 16". In some embodiments, a shorter barrel 124 requiring NFA registration of the firearm may be included. The shorter barrel 124 may be useful for use with a sound suppressor (silencer) attached to the shorter barrel, such that the combined length of the barrel 124 and sound suppressor is similar to a longer barrel without a sound suppressor, and hence that the muzzle end of the sound suppressor is still protected similarly to a longer barrel 124. That is, although the Figures illustrate only a barrel 124 indirectly supported by the buttstock assembly 102, in some embodiments, the buttstock assembly 102 may indirectly support a barrel 124 and a sound suppressor. An integrally suppressed barrel may also be used. In some embodiments, a barrel coupled to another elongated mechanism may be supported (not shown). The forend assembly 104 can also include the forend 126 configured for coupling to and supporting the barrel 124 in the deployed configuration. In the stowed configuration the forend 126 can fit into the forend assembly storage cavity 110 and be releasably coupled to the buttstock assembly 102 via one or more releasable fasteners. At the same time, a rear end of the barrel 124, or barrel shank 134, can be releasably coupled to the buttstock assembly 102 via a barrel receiver 128, as seen in detail in FIG. 4.

In some cases, the takedown firearm stock may include a firearm barrel tray 142 (which may be referred to herein as simply "tray" 142) (see FIGS. 1, 7-9) and the buttstock assembly 102. The buttstock assembly 102 may be a stock for a hunting rifle and may itself be an original equipment manufacturer (OEM)-supplied stock or may be used to replace an OEM hunting rifle stock. In some embodiments, the tray 142 may be removably coupled to or adjacent a first side of the buttstock assembly 102 (e.g., in the deployed configuration). Additionally or alternatively, the forend assembly 104 may comprise a recess or channel for receiving the barrel 124. Further, the forend assembly 104 may comprise a release mechanism 130 for removably coupling the forend assembly 104 and the buttstock assembly 102. The barrel tray 142 may removably couple to the forend assembly 104, where the barrel tray comprises a barrel channel 146 configured to receive, interface with, and directly support the barrel 124. In some cases, the barrel tray 142 may be attached such that the barrel channel 146 (see e.g. FIG. 7) is positioned within the forend assembly 104 and an accessory mounting interface 141 protrudes at least partially through an accessory recess 173 or passage in the forend assembly 104. In this way, a user may mount an accessory (not illustrated) directly to the tray 124 or an attachment bracket from the same or a second side of the forend. In some cases, the barrel tray 124 may be configured to couple to the forend assembly 104 upon application of pressure (e.g., a snap mechanism). Alternatively, the barrel tray 124 may be coupled to the forend assembly 104 using an attachment mechanism comprising one or more fasteners (e.g., screws), as further described in relation to FIGS. 7-9.

In some embodiments, the tray 142 may be made primarily of a high-strength engineering grade polymer and/or reinforced composite materials. In other cases, it may also be made of any other applicable material, such as a high-strength, durable, rigid, wear-resistant material, including but not limited to, metal or metal alloys. Greater rigidity, for instance, where higher-precision accessories likes scopes are used, may be achieved with comparatively heavier and more expensive materials, such as steel, aluminum or reinforced engineering polymers.

Certain modular locking accessory mounting systems in the industry, such as MAGPUL INC's M-LOK, deploy a material durable enough to prevent damage to the mounting slot when engaging (i.e., turning and seating) the nut. Co-owned U.S. Pat. Nos. 8,925,236, 9,239,209, 9,239,210, 9,523,554, and 9,429,388 and 9,976,832 for such a modular locking accessory mounting interface system are incorporated herein by reference. In some cases, strength is also needed to withstand the force often applied to the various accessories either intentionally (such as when attaching a bipod or sling) or inadvertently (such as when accidental drops or impacts occur).

In some embodiments, the buttstock assembly 102 may be made of a lower-cost engineering polymer or a commodity plastic. Further, the tray 142 may be made of a material that has a strength, rigidity, and/or weight that is greater than a strength, rigidity, and/or weight of the buttstock assembly 102. In some cases, the tray 142 may be shaped to resist deformation to a greater degree than the stock. In some embodiments, the tray may be made from a material that is at least 40-50% denser than the material used to form the stock 102. It should be noted that the density range noted above is merely an example, and not intended to be limiting. Other density ranges (e.g., 25% more dense, 30% more dense, etc.) are contemplated in different embodiments. In some embodiments, the tray 142 or any portion thereof used to form an accessory mounting interface 141 may be made from a material that is, for example, anywhere from 2-8 times heavier, 2-25 times stronger, and 10-30 times stiffer than a material used to form another part of the tray 142, the forend assembly 104, and/or the buttstock assembly 102. It should be noted that, the ranges described herein are exemplary only, and other suitable ranges may be used.

Figure 2:
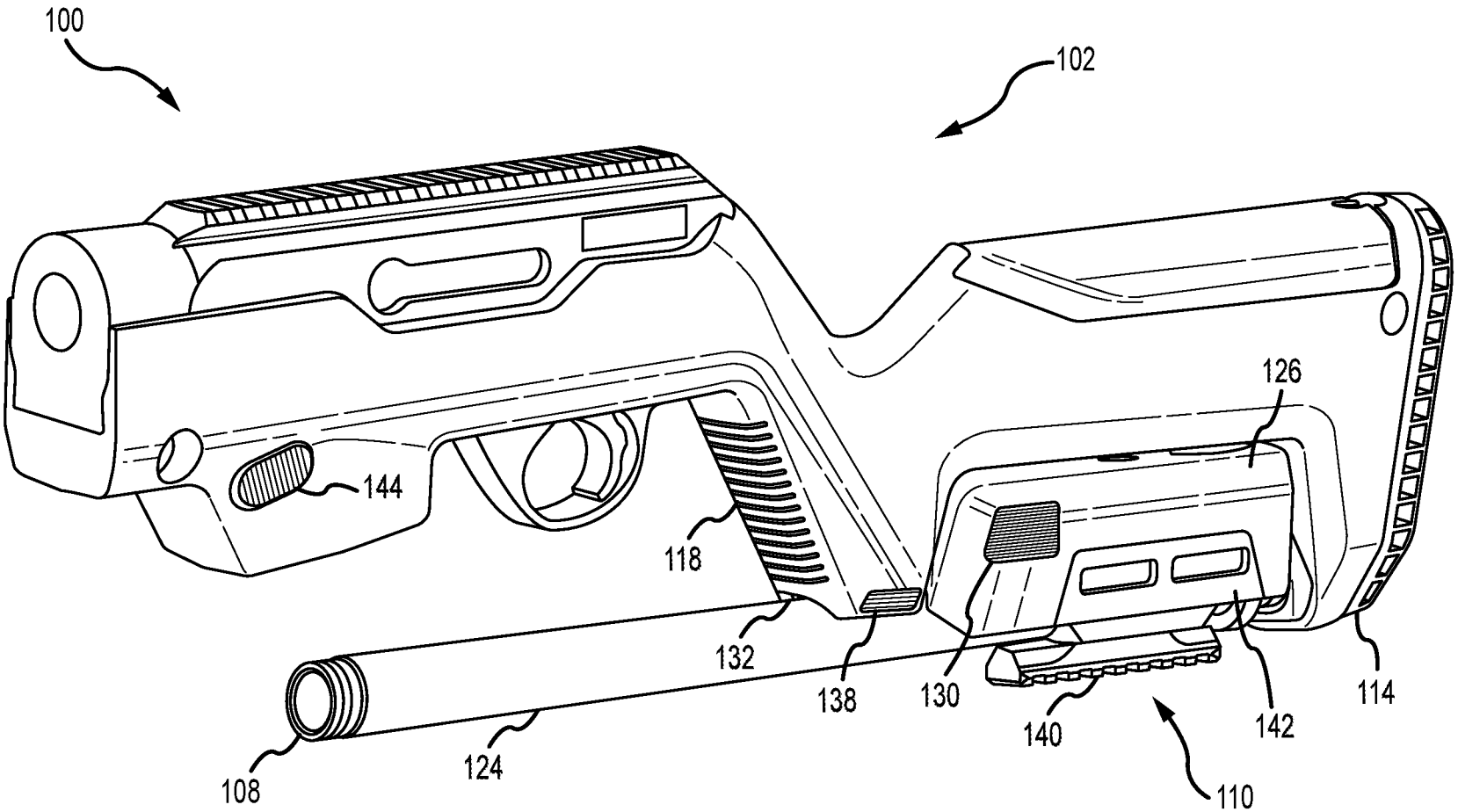
FIG. 2 is a perspective view of the takedown firearm and buttstock assembly in FIG. 1 in a stowed configuration.
Figure 3:
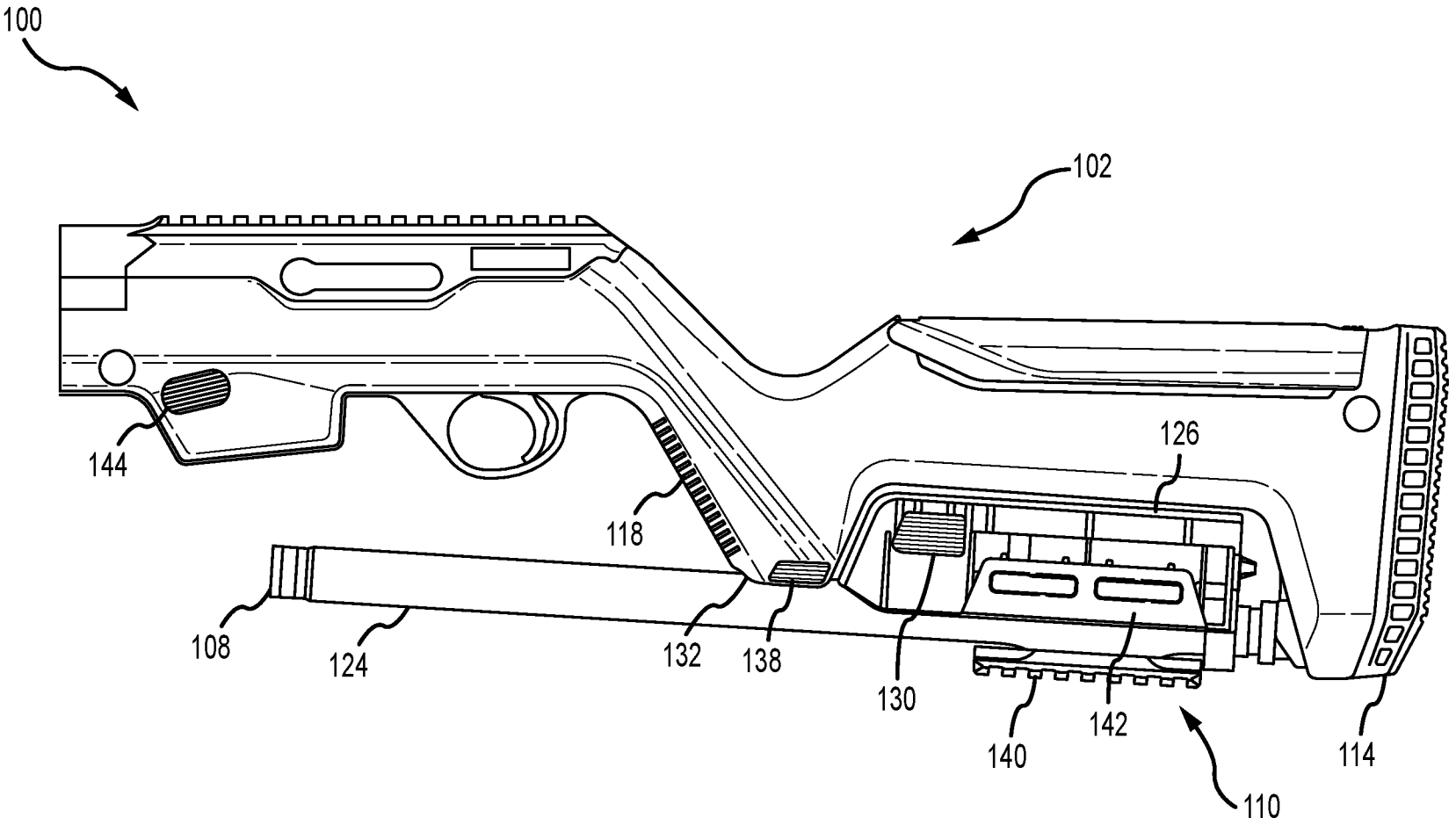
FIG. 3 is a side view of the takedown firearm and buttstock assembly in FIG. 2.

FIG. 2 illustrates the stowed (or storage) configuration of the firearm 100 illustrated in FIG. 1. In some cases, FIG. 2 may implement one or more aspects of the figures described herein. In both the deployed and stowed configurations, the barrel 124 faces toward a front (i.e., firing end) of the firearm 100. The forend assembly storage cavity 110 may be shaped to generally conform to a shape of the forend 126. For instance, as shown, the forend 126 is generally rectangular with a slight acute angle (i.e., from the perpendicular) at a front end. Accordingly, the forend assembly storage cavity 110 is generally rectangular, and also includes a slight angle (e.g., an obtuse angle) at the front portion 120 that mimics the angle at the front of the forend 126, but inverted (or flipped vertically). It should be noted, however, that the forend assembly storage cavity 110 does not need to perfectly mimic the shape of the forend 126. For instance, at a rear portion 122 of the forend assembly storage cavity 110, the forend assembly storage cavity 110 may be angled to a greater extent than a rear edge of the forend 126 when in the stowed configuration (see FIG. 2).

Figure 14:
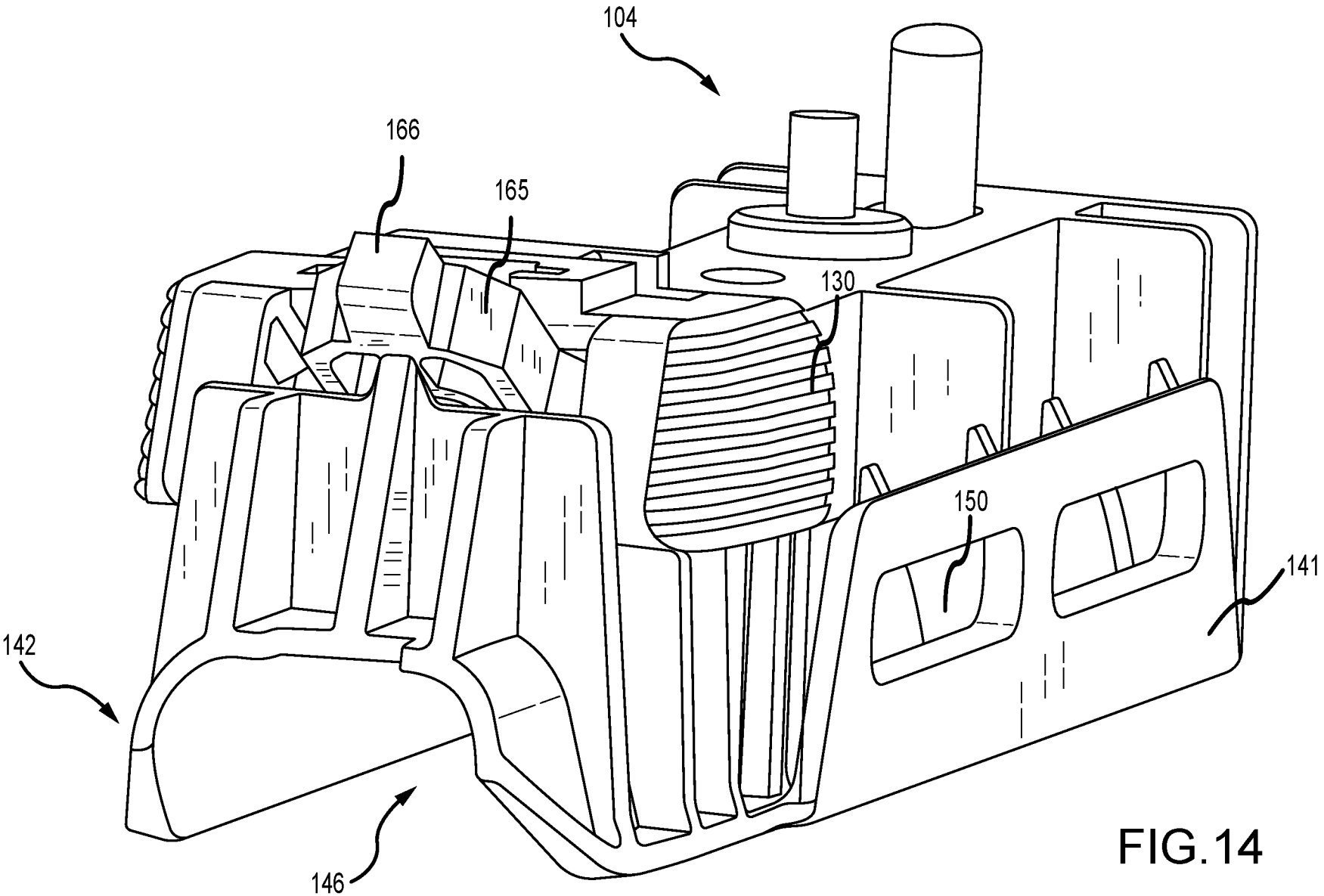
FIG. 14 is a detailed view of the barrel tray and the release mechanism in FIG. 13 with the forend shell removed.
Figure 15:
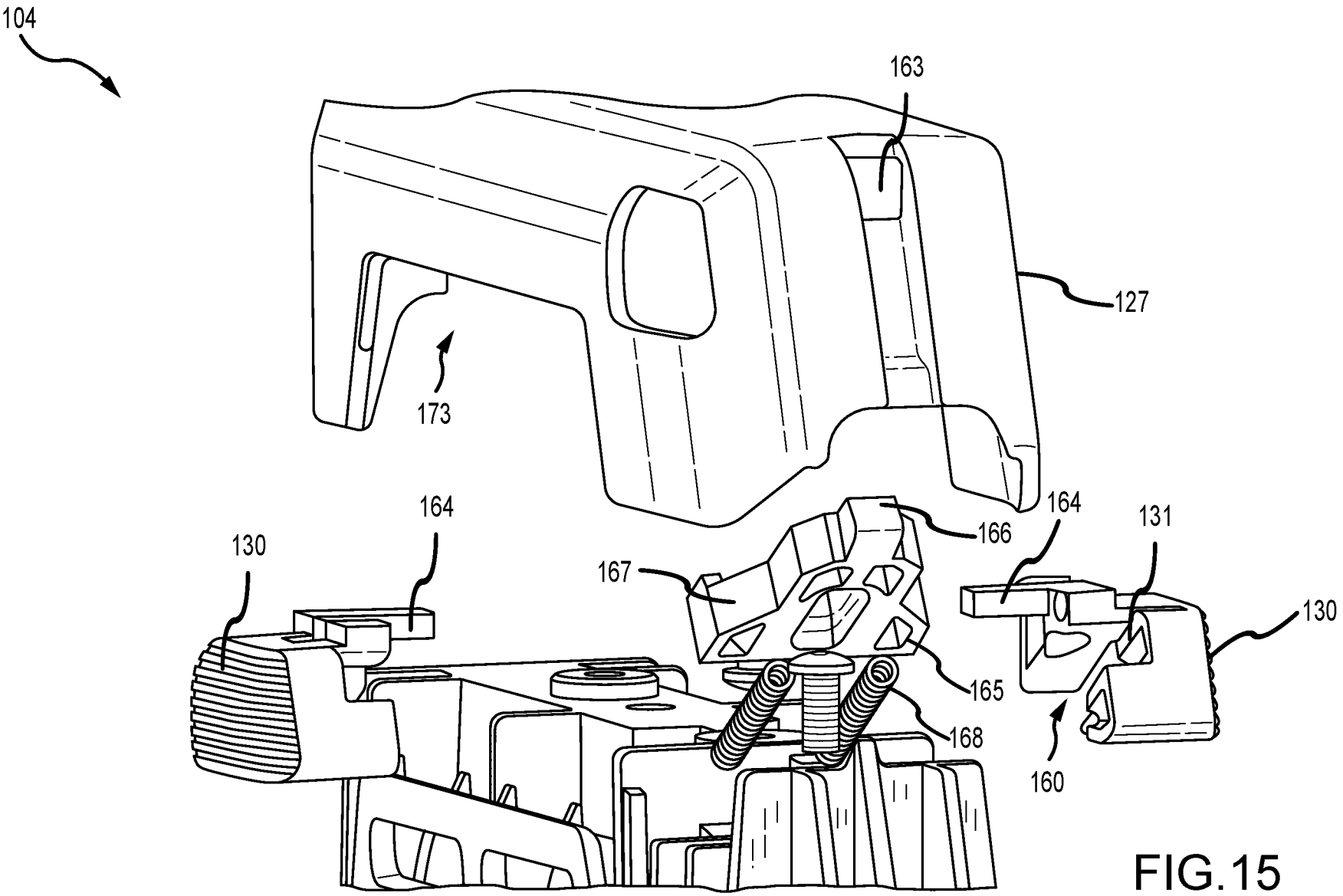
FIG. 15 is an exploded view of the forend assembly, including the forend shell, the release mechanism, and the barrel tray in FIG. 12.

In some embodiments, the forend 126 can include a release mechanism comprising one or more buttons 130 (e.g., one on each side of the forend 126), although other release mechanisms are contemplated in different embodiments. In some cases, a user can depress either or both of the buttons 130 of the release mechanism in order to release the forend assembly 104 from the stowed configuration (e.g., via movement of a latching detent 165 as seen in FIGS. 14-15). In particular, depressing the buttons 130 or any other type of release mechanism being used, may release a coupling between the grip 118 and the front of the forend 126. In some embodiments, depression of the buttons 130 or activation of the release mechanism may also be used to couple the forend 126 to the grip 118 and thereby place the firearm 100 into the stowed configuration. Alternatively, coupling of the forend 126 to the grip 118 may self-bias the buttons 130 and allow coupling to the grip 118.

In the illustrated embodiment, a bottom of the grip 118 is shaped to generally replicate or partially surround the barrel 124 (see, especially FIGS. 2-5). In particular, the bottom of the grip 118 may include a barrel recess 132 (e.g., a concave or curved recess) to receive or abut the barrel 124. In other words, the bottom of the grip 118 may be shaped like or similar to the barrel 124 so as to allow the barrel 124 to more closely fit relative to the grip 118, or nest at least partially within a bottom end of the grip 118, and thereby provide a more compact overall shape of the firearm 100 in the stowed configuration. In the illustrated embodiment, the barrel 124 does not touch the grip 118 or the barrel recess 132, although in some embodiments such contact may be employed. More specifically, contact between the barrel 124 and the grip 118 or the recess 132 may be used to provide additional structure, stability, and/or support, which may serve to offset stress and minimize the likelihood of damaging the latching detent (e.g., latching detent 165 in FIGS. 14-15) and/or tab 151 during rough handling in the stowed configuration. In some examples, the barrel recess 132 may also be shaped to accommodate a widest barrel 124 diameter expected (e.g., a bull barrel or integrally suppressed barrel), thus leaving a gap relative to smaller-radius barrels (e.g., a tapered barrel).

As illustrated in FIGS. 2 and 3, in some cases, the barrel 124 may not be in line with or parallel to a longitudinal axis through the receiver when the firearm 100 is in the stowed configuration. The result is a more compact firearm 100 shape in the stowed configuration than if the barrel 124 remained parallel with its alignment in the deployed configuration.

In some instances, the takedown firearm stock or the firearm 100 can be shaped such that the muzzle 108 does not extend beyond a front of the buttstock assembly 102 (i.e., the forend-to-stock interface 106). This, in addition to the angled barrel 124 may serve to protect the muzzle 108 in the stowed configuration. While minor physical impacts to the barrel 124 are unlikely to cause accuracy-degrading damage to the firearm 100, even minor impacts to the muzzle 108 can greatly influence accuracy and even safety of the firearm 100 since the inside of the barrel 124 is exposed at the muzzle 108. To protect the cartridge chamber at the rear end of the forend assembly 104, or the forend assembly 104 side of the forend-to-stock interface 106, the barrel receiver 128 may be shaped and arranged to receive the barrel 124. In this way, the fragile barrel 124 interface that couples to the receiver, as well as the inside of the barrel 124, can be protected. In some embodiments, the barrel receiver 128 can partially surround a portion of the barrel 124, for instance, the barrel shank 134. In some embodiments, the barrel receiver 128 may be composed of a rubberized thermoplastic material, although other applicable materials are contemplated in different embodiments.

Figure 4:
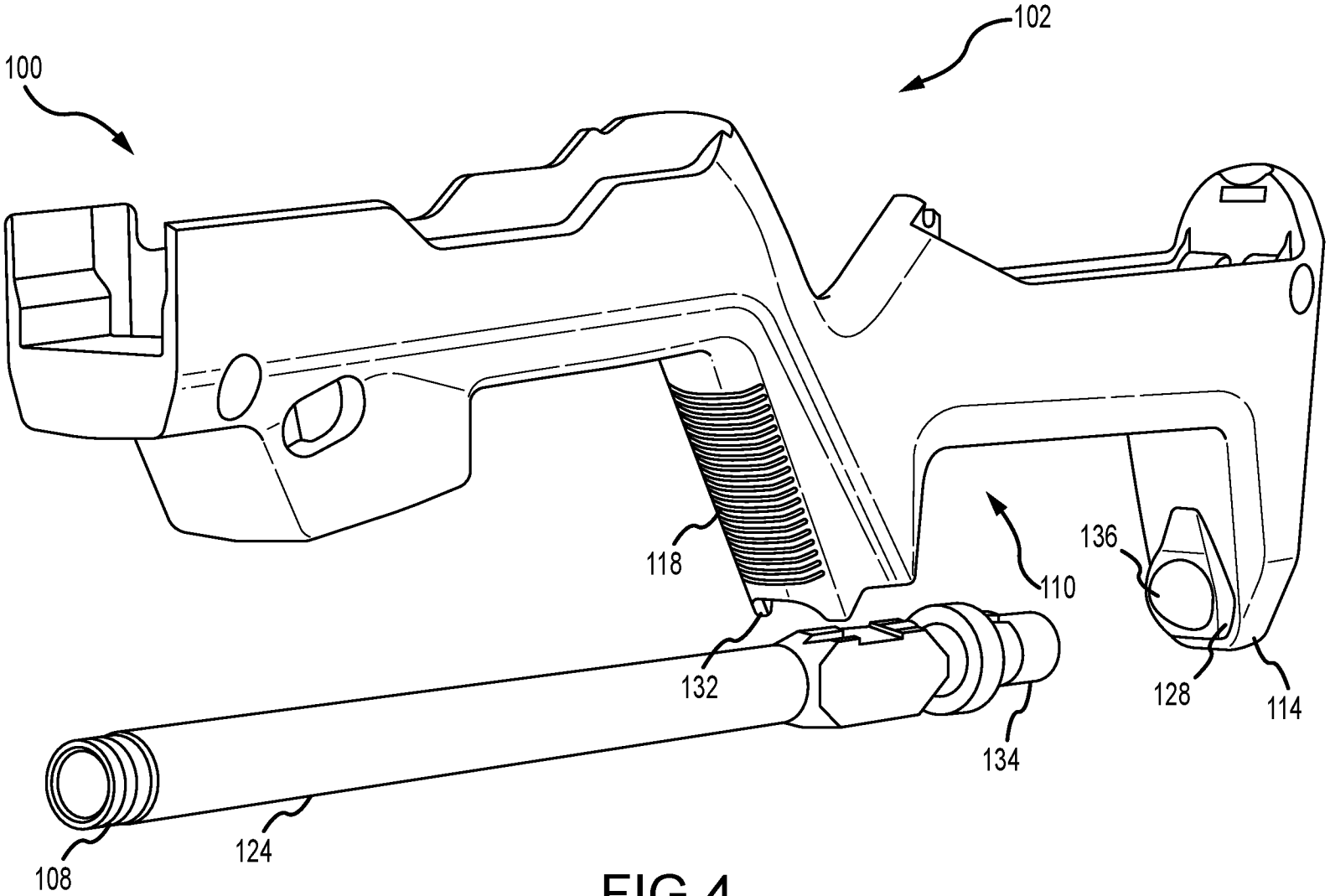
FIG. 4 is an exploded perspective view of the firearm barrel and the buttstock assembly with the forend removed.

With reference to FIG. 4, the barrel 124 can include a barrel shank 134 at a rear of the barrel 124, configured to couple to the receiver of the action assembly 112, for instance, via a threaded engagement. In some cases, this barrel shank 134 is configured to slide into the receiver, for instance, in the deployed configuration. In the stowed configuration, the barrel shank 134 may be configured to slide into the barrel receiver 128, and in particular, into an aperture 136 in the barrel receiver 128. In some cases, the aperture 136 may be generally cylindrical, and may comprise a generally circular or ovular opening recessed into the buttpad 114. In some cases, the recess may be deep enough to allow an entirety of the barrel shank 134 to fit within the barrel receiver 128 (and within the butt pad 114). In other words, the recess may be deep enough to allow an entire threaded portion of the barrel shank 134 to fit within the barrel receiver 128, thereby protecting an entirety of the threaded portion. The aperture 136 may have a larger diameter than a diameter of a receptable in the receiver that accepts the barrel shank 134, since the receiver may include a threaded receptacle, while the aperture 136 and the barrel receiver 128 recess may not be threaded.

In some circumstances, after releasing the forend 126 from the stowed configuration, for instance, via the release mechanism, a front of the forend 126 can be lowered to allow the forend assembly 104 to be moved forward (i.e., to decouple the barrel 124 from the barrel receiver 128). In some cases, the aperture 136 may be ovular and oriented to allow the barrel shank 134 to pivot up and down within the aperture 136 (e.g., along a major axis of the oval). In this way, removing the forend assembly 104 may include first releasing a front portion 120 of the forend assembly storage cavity 110, then pivoting the front portion 120 downward about a pivot point at the barrel receiver 128 or rearward thereof until the forend 126 clears the grip 118, following which the barrel shank 134 may be slid out of the aperture 136 with the forend 126 moving forward and below the grip 118. Alternatively to using an ovular aperture 136, or along with using an ovular aperture 136, the barrel receiver 128 may be adapted to flex with the barrel 124 as the barrel 124 is rotated out of the aperture 136. This describes some embodiments of the actions and movements for releasing the forend assembly 104 from the stowed configuration, and a reverse of this procedure would allow stowage of the forend assembly 104. However, for stowage, the buttons 130 or other release mechanism may or may not need to be depressed or activated in order to stow the forend assembly 104. In some examples, the release mechanism may include a detent or snap-fit type mechanism for receiving and securing the forend assembly 104.

Thus, the forend 126 may be releasably couplable to a front portion 120 of the buttstock assembly storage cavity 110 and may be released therefrom via depression of the one or more buttons 130, or operation of another release mechanism (if any). In some cases, the forend 126 may slidingly engage with a rear 122 of the buttstock assembly storage cavity 110, in particular via a sliding engagement between the barrel 124 (or a barrel shank 134 thereof) and the barrel receiver 128. In some aspects, different barrels can be used with the firearm 100 without having to adjust any components of the buttstock assembly 102.

The forend assembly 104 may include a release mechanism for coupling the buttstock assembly 102 and the forend 126. The release mechanism may include a detent engagement (e.g., latching detent 165 in FIG. 15) between the buttstock assembly 102 and the forend 126 and/or a lever engagement (not shown) between the buttstock 102 and the forend 126. The release mechanism may have the one or more buttons 130 and a detent engagement, where the one or more buttons 130 are configured to release the detent engagement when depressed, further described in relation to FIGS. 6 and 12-15.

With reference to FIG. 5, in some embodiments, the takedown firearm stock may further comprise a storage compartment 170 in the buttstock assembly 102. In some examples, the storage compartment 170 may comprise one or more detachable cheekpieces 116 forming a top portion of the storage compartment 170, and a release mechanism for enabling detachment of the one or more cheekpieces 116, further described in relation to FIGS. 16 and 17.

In some cases, an attachment bracket (not visible due to being hidden by the forend shell 127) may be utilized in place of a barrel tray with an attachment mechanism, where the attachment bracket may be configured to support the barrel. The attachment bracket may be made from any applicable material, such as a high-strength polymer, composite, or metal. Furthermore, the attachment bracket may comprise accessory slots (e.g., similar to elongated slots 150 in FIG. 7) that are compatible with modular locking accessory attachment systems. In some cases, the attachment bracket may comprise a barrel mounting bracket (with or without a clamp), a cylinder mounting bracket, a L-type bracket, a U-type or channel bracket, a Z bracket, to name a few non-limiting examples. In some cases, the barrel mounting bracket may be an inside mount bracket, for instance, when the bracket does not comprise a clamp. In such cases, the diameter of the inside mount bracket may be slightly larger than the outer diameter of the barrel. In some cases, the barrel may be configured to couple to the inside mounting bracket (or alternatively, an outside mounting bracket), for instance, via a threaded engagement. Additionally or alternatively, the barrel may be configured to be clamped within the barrel mounting bracket to secure it in place. In some other cases, an adjustable bracket barrel mount holder (e.g., with rail clamps or some other adjustment mechanism) may be utilized, which may allow for use with different barrel diameters.

Figure 6:
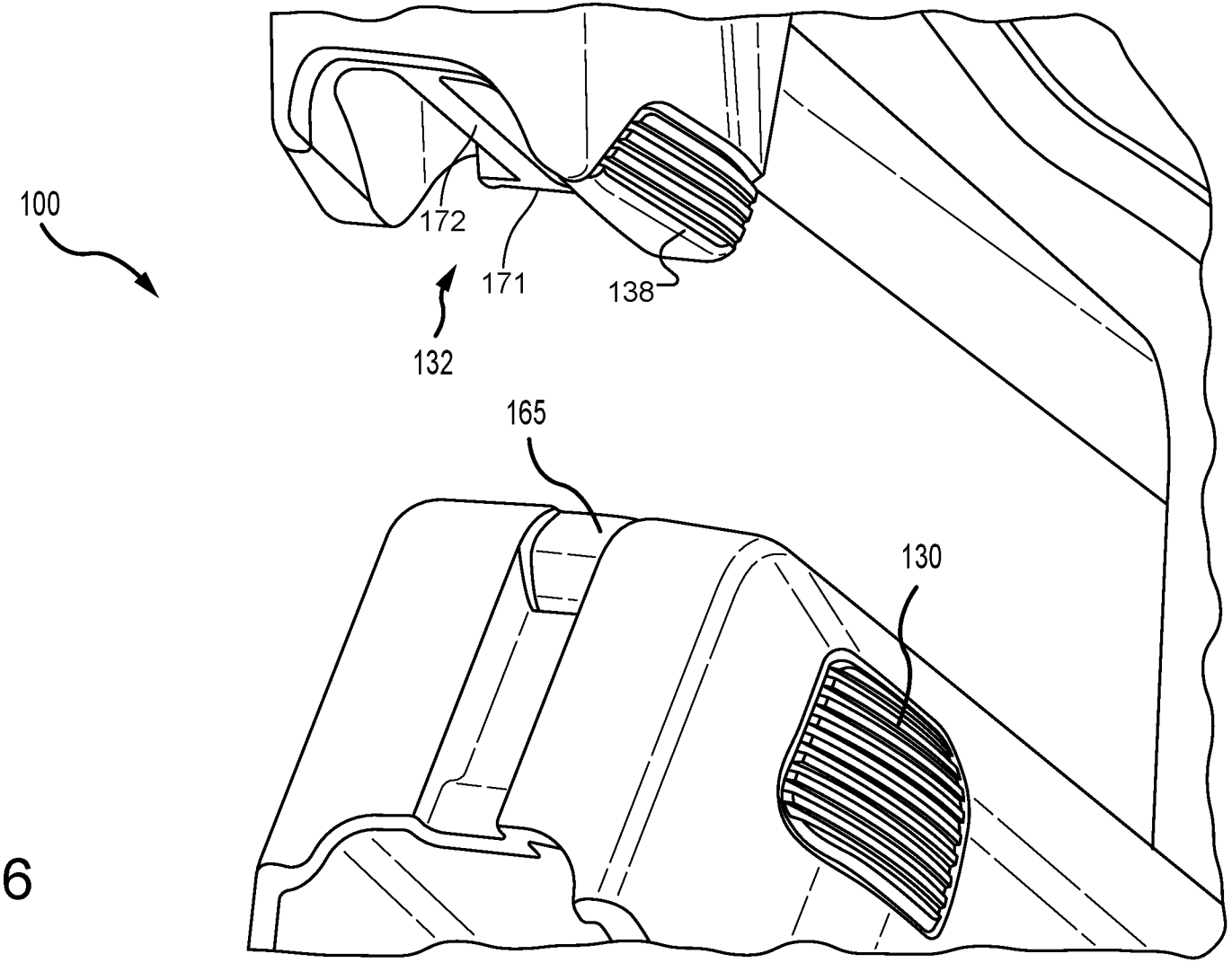
FIG. 6 is a detailed view of an embodiment of engagement between the forend assembly and buttstock assembly in FIG. 1

FIG. 6 shows the bottom of the grip 118 and the forend 126 in a partially exploded view without the barrel 124, such that the barrel recess 132 may be seen without obstruction. In some embodiments, the barrel recess 132 may be formed in part by the grip 118 and in part by a grip insert 138. The grip insert 138 can be seen in isolation in FIG. 11. In some examples, the grip insert 138 may extend up into the grip 118 and may be releasably coupled within the grip 118. In some embodiments, two or more grip inserts 138 having barrel recesses 132 shaped to fit different barrel types may be replaceable and/or arranged within the grip 118. For instance, a variety of rifles may be configured with a traditional tapered barrel or with a competition or bull barrel without a taper. In such cases, two different grip inserts 138 may be used relative to the firearm 100, where a first grip insert 138 may be shaped to partially surround a tapered barrel and a second grip insert 138 may be shaped to partially surround a bull barrel. In some circumstances, the grip insert 138 may be partially exposed outside of the grip 118 to enable a user to remove and/or replace the grip insert 138.

Figure 7:
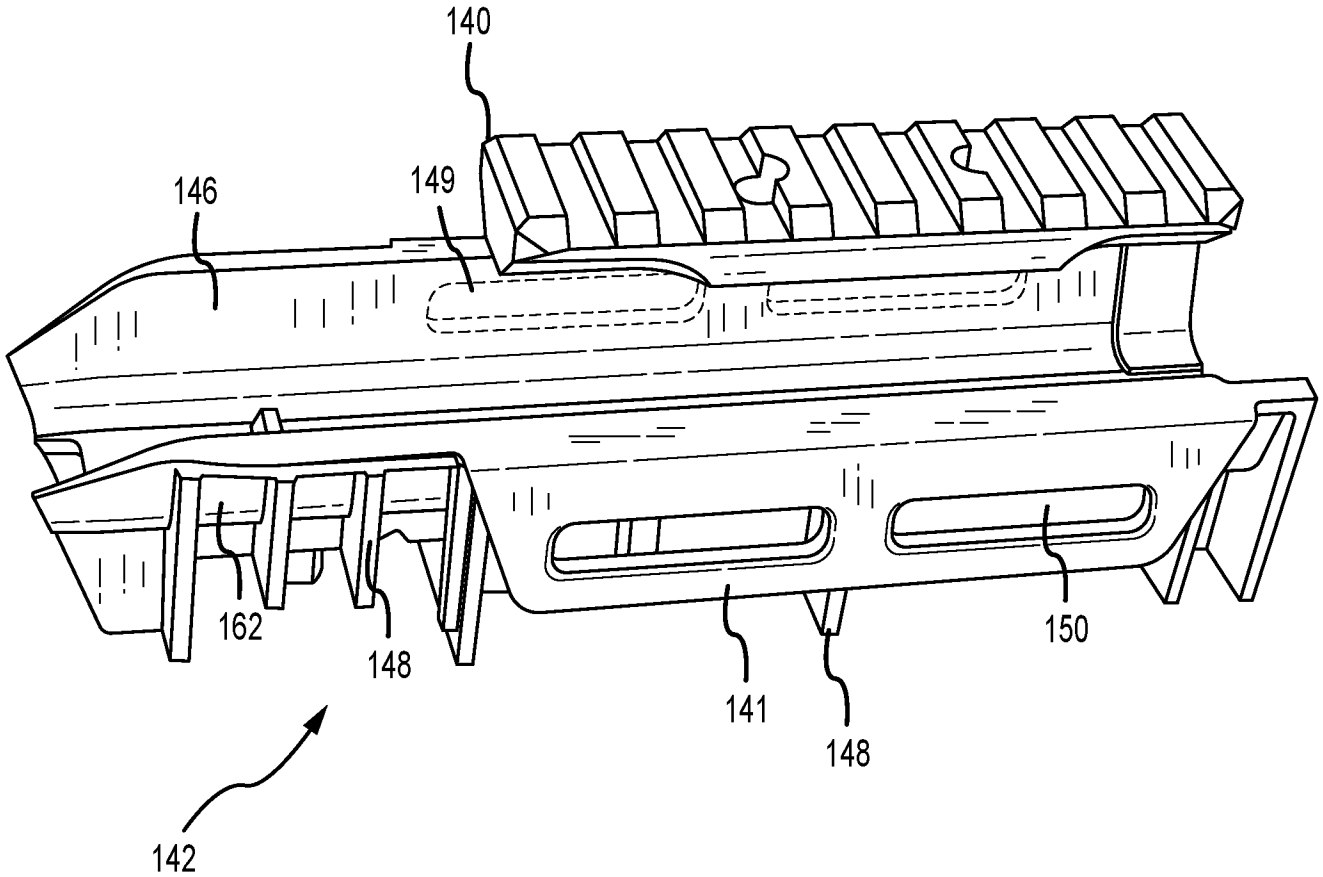
FIG. 7 is a top perspective view of the firearm barrel tray and the optional optical mount illustrated in FIG. 1.
Figure 8:
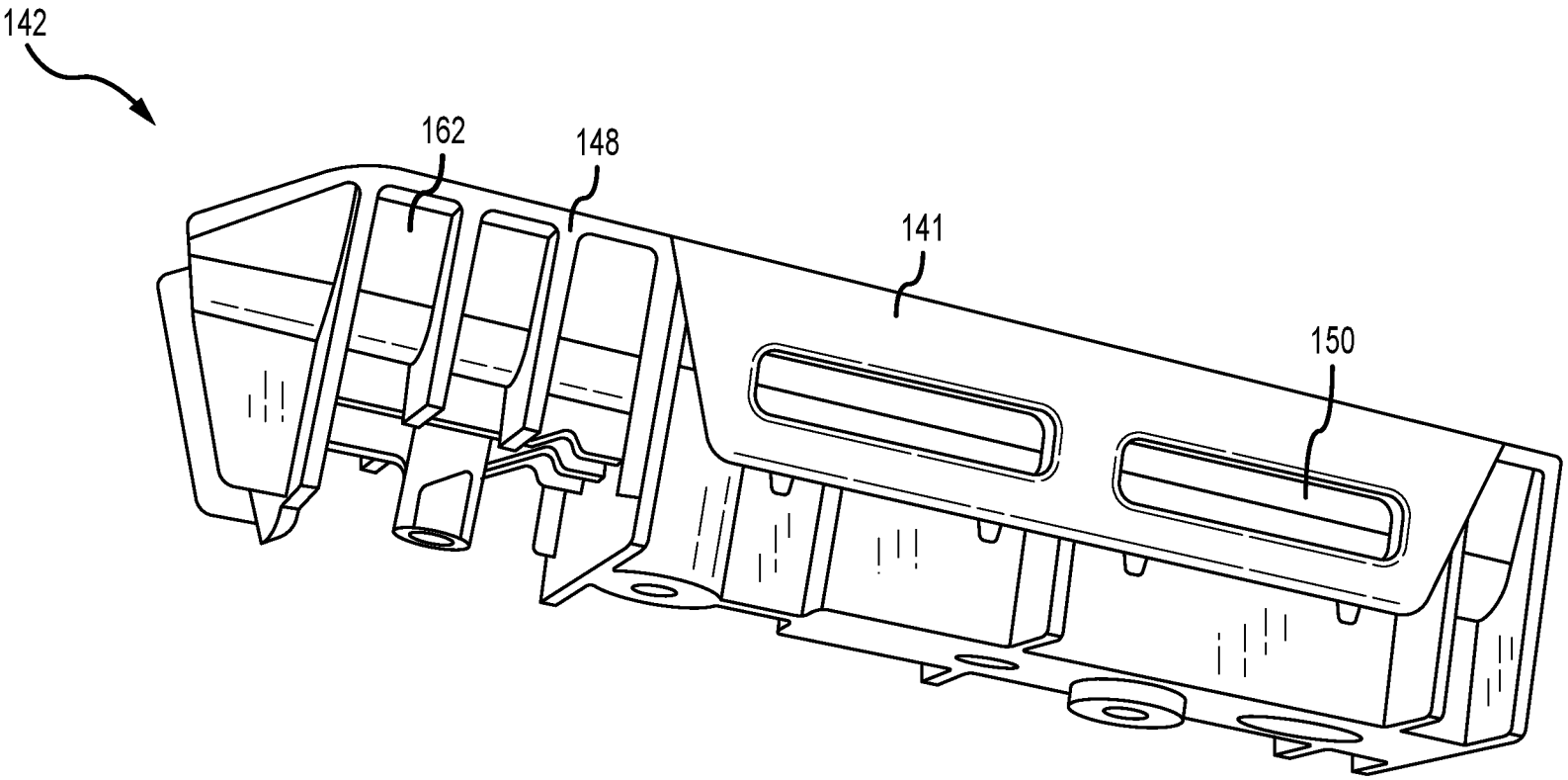
FIG. 8 is a bottom perspective view of the firearm barrel tray in FIG. 1.
Figure 9:
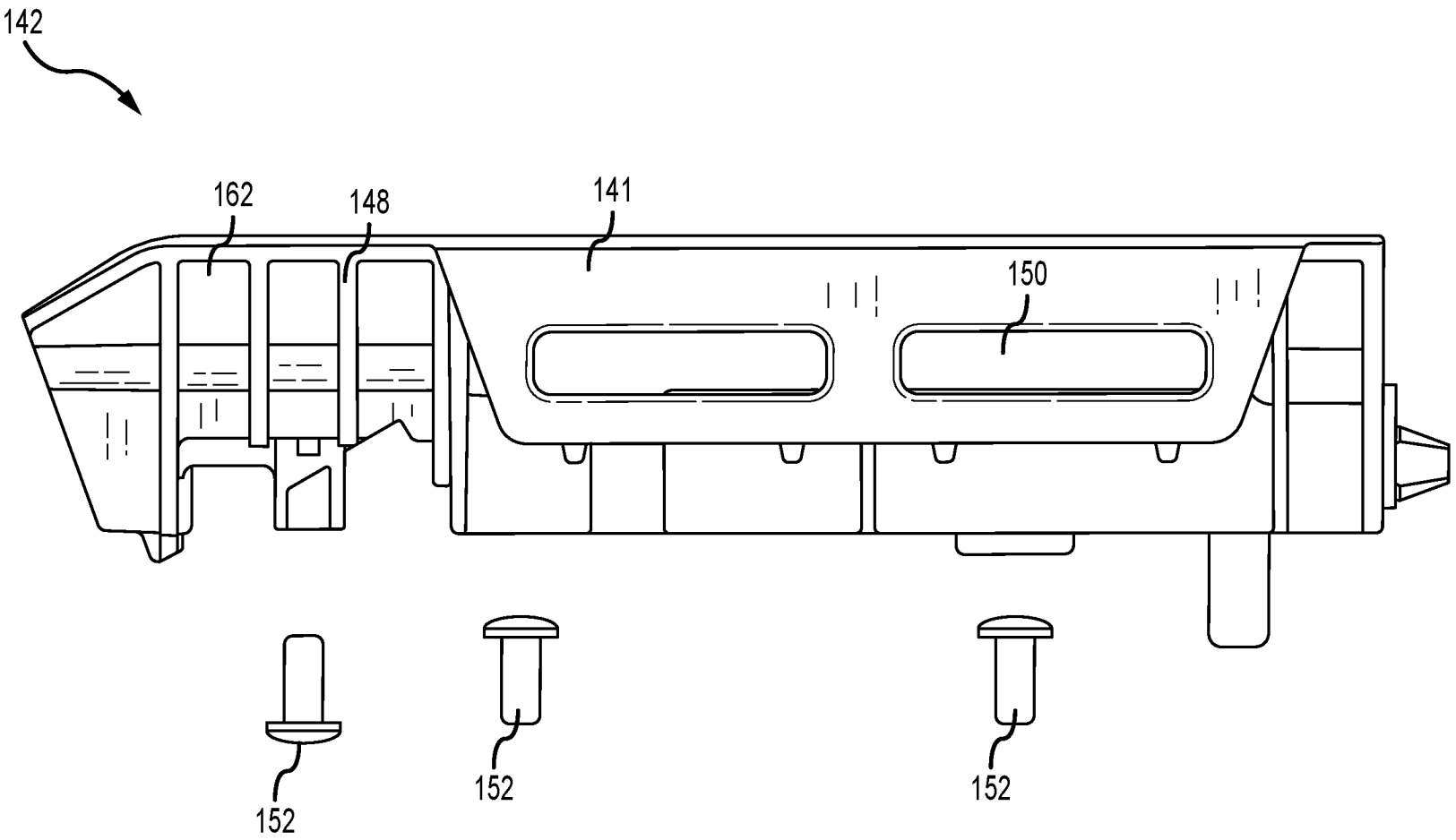
FIG. 9 is an exploded side section view of the firearm barrel tray.

FIG. 7 is a top perspective view of the firearm barrel tray 142 and an optional optical mount 140 illustrated in FIG. 1. Further, FIGS. 8 and 9 illustrate a bottom perspective view and an exploded side section view, respectively, of the firearm barrel tray 142.

As shown in FIG. 7, the barrel tray 142 may comprise a barrel channel 146 unitary with or directly coupled to an accessory mounting interface 141. In some cases, the barrel channel 146 may be configured to receive and interface with a barrel (not shown). The barrel channel 146 may include one or more cutouts 149 for allowing air flow through elongated slots 150 of the accessory mounting interface 141, which could aid in cooling the barrel. In some aspects, the cutout design may also serve to reduce an overall weight of the tray 142 by removing unnecessary, and possibly heavier, materials. As previously described, the forend assembly (e.g., forend assembly 104 in FIG. 1) may comprise a recess for receiving a barrel having a barrel shank. In some cases, the barrel tray 142 may be removably coupled to the forend assembly. For instance, the barrel tray 142 may be configured to couple to the forend assembly upon application of pressure, or alternatively, the barrel tray 142 may be coupled to the forend assembly using an attachment mechanism comprising one or more fasteners, as further described in relation to FIG. 9.

The accessory mounting interface 141, which may be located on one or more sides of the forend 104 may include one or more elongated slots 150. The accessory mounting interface 141 may include a modular locking accessory mounting system for hard mounting one or more accessories to a negative space mounting point. The accessory mounting interface 141 may include one or more slots compatible with the MAGPUL M-LOK system, for example. In some cases, such "negative space" attachment systems may allow a user to install mounting rails (not shown) only where needed, as opposed to covering the entire surface of the accessory mounting interface 141 with mounting rails. In some circumstances, such systems may also support direct mounting of accessories, such as fore-grips and flashlights, without any rail interface.

As described above, a high-strength, rigid, durable material resistant to deformation may surround the elongated slots 150, which may serve to minimize damage when engaged with a modular locking accessory mounting system. Though not shown, in some embodiments, the elongated slots may be located on a different portion of the tray 142, such as on the bottom, and may exist in place of or in addition to accessory slots or recesses on the side of the forend and/or the stock. In some examples, the forend may have corresponding recesses that allow the elongated slots to be accessible from the sides and/or bottom.

As illustrated, the tray 142 may include one or more reinforcing ribs 148 on a supporting wall 162. In some cases, the supporting wall 162 may connect the barrel channel 146 to the accessory mounting interface 141. Similarly, the forend assembly 104 may include one or more reinforcing ribs, where the reinforcing ribs may be positioned so as to minimize a tendency of the tray 142 and/or forend assembly 104 to rotate or bend relative to a longitudinal axis, such as a longitudinal axis defined by a firing direction.

In some cases, the tray 142 may be removably attached to the forend assembly 104 using one or more fasteners 152 (as illustrated in FIG. 9). The fasteners 152 may be inserted on a first side of the forend assembly 104. For instance, the fasteners 152 may be threaded, and may pass through the tray 142 for engagement with one or more threaded recesses in the forend assembly 104. A threaded screw fastener may allow for a secure connection between the tray 142 and forend assembly 104. In some cases, the tray 142 and forend assembly 104 may be manufactured as separate pieces because they are formed using different materials. In some other embodiments, other fasteners or attachment mechanisms may be implemented. In one example, the forend may be configured to receive the tray 142 upon application of pressure (e.g., the tray 142 snaps into place through pressure).

The tray 142 may be attached to the forend assembly 104 in a position such that the tray 142 is positioned roughly middle of the forend assembly 104. In some cases, an accessory mounting interface 141 may partially extend through a recess in the forend assembly for mounting one or more accessories to the barrel tray or an attachment bracket. In some examples, the accessory mounting interface may be accessible from one or more sides of the forend. In some cases, the accessory mounting interface may be substantially flush with the side surface profile of the forend assembly. By the phrase "positioned on," it is to be understood that the terms "nested" or "seated into" would also be appropriate synonyms for the purpose of this disclosure.

In some embodiments, the barrel channel 146 may be adapted to support a tapered barrel, meaning that a front portion of the barrel channel would be narrower than a rear portion of the barrel channel. In some embodiments, the barrel channel 146 may be adapted to support a straight or bull barrel, meaning that the length of the barrel channel that interfaces with the barrel has a uniform width. The tray 142, forend assembly 104, and/or buttstock assembly 102 may be configured for particular popular models of firearms having receivers and barrels of a particular size. Such firearms may come with standard stocks and/or forends which may be easily replaced with the tray, forend, and/or buttstock system of the present disclosure.

In some other cases, the forend assembly 104 may be configured to interface solely with an attachment bracket rather than a barrel tray with an attachment mechanism. In such cases, the forend assembly 104 may not be configured to interface with a separate barrel tray, but may itself support a barrel (e.g., tapered or straight) by its shape. The attachment bracket may be made from any applicable material, such as a high-strength polymer, composite, or metal. Furthermore, the attachment bracket may comprise accessory slots (e.g., similar to elongated slots 150) that are compatible with modular locking accessory attachment systems. These accessory slots may be similar or substantially similar to the accessory slots of the attachment mechanism described above. In some cases, such a design of the forend assembly 104 may serve to further minimize weight and/or manufacturing costs.

Figure 10:
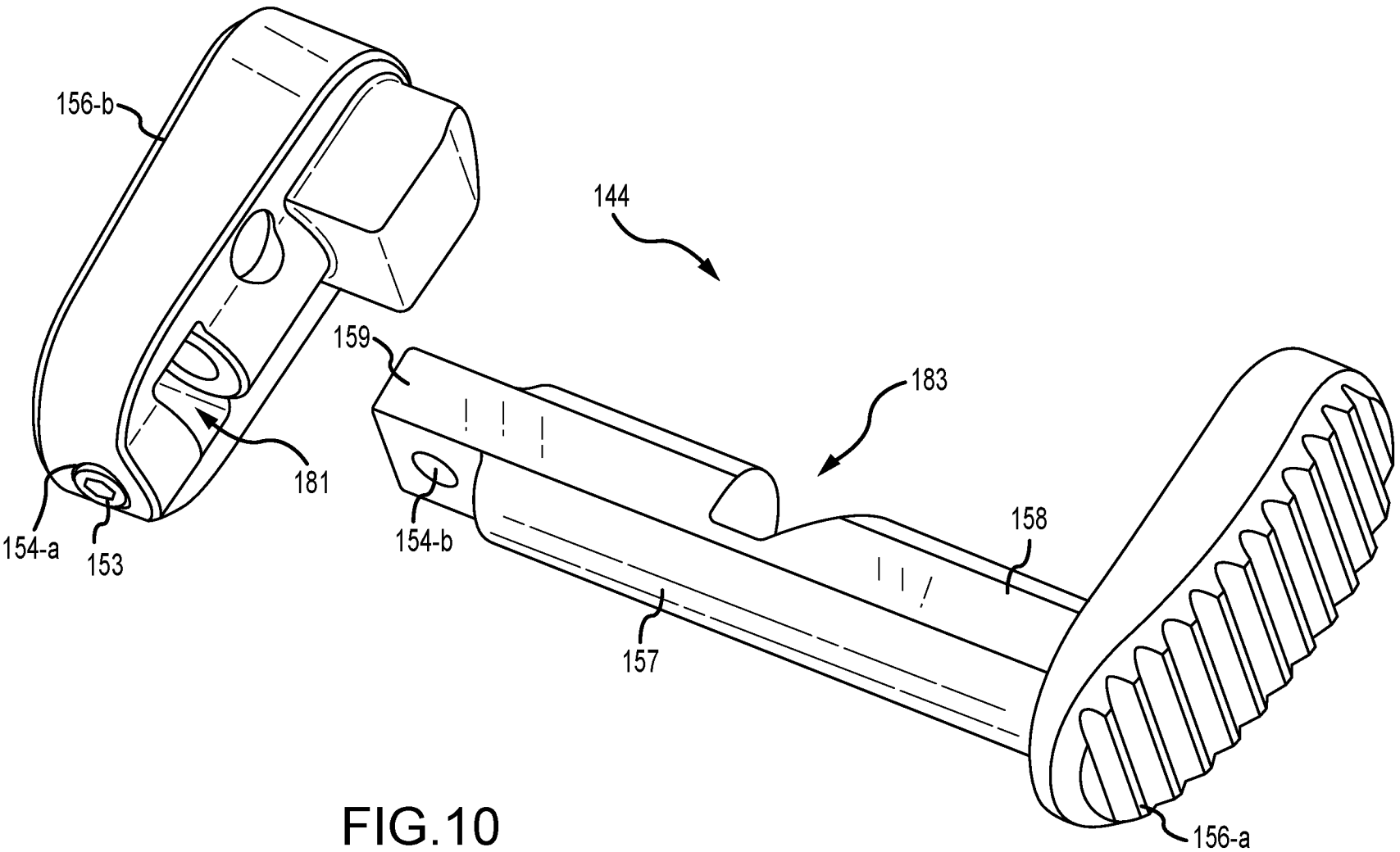
FIG. 10 is an exploded view of the magazine release.

FIG. 10 shows a detailed and exploded view of the magazine release 144 of the buttstock assembly 102. In some examples, the magazine release may also be referred to as a magazine release assembly or magazine release mechanism. As illustrated, the magazine release 144 may comprise one or more buttons 156 (e.g., button 156-*a* and 156-*b*), a shaft 157 of the button 156-*a* (or button 156-*b*), and a set screw 153 arranged perpendicular to the shaft 157. In some embodiments, the buttons 156 may be installed within cutouts or openings in the receiver or the buttstock assembly 102 and may be accessible from one or more sides of the buttstock assembly 102. In some cases, a first button 156-*a* may be installed within a first cutout on a first side of the buttstock assembly, while a second button 156-*b* may be installed within a second cutout on a second side of the buttstock assembly, the first side opposing the second side. Further, the magazine release 144 may comprise a notch 183 configured to interface with a tab (not shown) within the receiver to prevent lateral (left-right) movement of the magazine release 144 with respect to the receiver and/or buttstock assembly 102. In some cases, a user may hold and selectively release the magazine (not shown) from the magazine well of the firearm by pushing or moving the button 156-*a* or 156-*b*. As described above, in the prior art, magazine release buttons may be susceptible to rotation due to constant release and attachment of the magazine from the magazine well. In such cases, a user may need to manually adjust the position of the button, or tighten the button, when installing the button or after repeated button use. For example, pressing and depressing the button of the magazine release may cause the button to rotate due to loosening of the screw holding the button in place. In order to mitigate this issue, a shaft 157 of the button 156-*a* (or 156-*b*) may include one or more keying features, such as flat 158, or a rectangular end 159, to prevent rotation, for instance, of the entire magazine release assembly with respect to the receiver, the buttons 156-*a* and/or 156-*b* with respect to the receiver or the buttstock assembly 102, and/or the button 156-*a* with respect to button 156-*b*, and subsequent adjustment of the buttons 156-*a* and/or 156-*b* of the magazine release 144.

In some examples, keying may involve installing the buttons 156-*a* and 156-*b* of the magazine release 144 flush (i.e., not raised or extended) with the side profile of the firearm buttstock assembly 102, although in other examples, the buttons 156-*a* and 156-*b* may be raised or extended with the side profile of the firearm stock 102. Since the buttons 156-*a* and/or 156-*b* may include some curvature to their outer faces, it is also possible for a portion of one or both of the buttons 156 to be flush with the side profile of the firearm buttstock assembly 102.

In some embodiments, the shape of the shaft 157 of button 156-*a*, and its interaction with the button 156-*b* may also serve as a keying feature. As illustrated, the shaft 157 may comprise a flat section 158 with a rectangular end 159 shaped and sized to fit within a recess 181 in the button 156-*b*. In this way, the rectangular end 159 is keyed with the button 156-*b*, since the rectangular end 159 can only mate with the recess 181 (i.e., be received within the recess 181) in a single orientation, for instance, when the top and bottom edges of the rectangular end are parallel to the top and bottom edges of the recess 181. In other words, once the rectangular end 159 is received within the recess 181, the rectangular end 159 (and button 156-*a*) may be prevented from rotating with respect to the button 156-*b*.

In some examples, the rectangular end 159 may comprise an aperture 154-*b* along its bottom edge, where the aperture 154-*b* may pass through a narrow section of the shaft 157. Once this narrow section keys into the similarly-shaped recess 181 in the inside of the button 156-*b*, the aperture 154-*b* may align with aperture 154-*a* of the button 156-*b*. In some instances, keying may also involve installing a set screw through a button 156 (e.g., button 156-*b*) and the shaft 157, which may serve to minimize rotation of the buttons 156 with respect to each other and/or the entire magazine release 144 with respect to the receiver. For instance, as illustrated in FIG. 10, a hidden set screw 153 may be arranged perpendicular to the shaft 157 and passed through the aperture 154-*a* in the bottom end of the button 156-*b* and aperture 154-*b* in the end of the shaft 157 to connect the buttons 156-*a* and 156-*b*. In some circumstances, the hidden set screw 153 may be used in place of a larger screw, parallel to the shaft 157, and through the buttons 156-*a* and 156-*b*. Such a design may serve to not only improve the aesthetics of the buttstock assembly (i.e., since the hidden set screw 153 may not be visible from an exterior side of the buttstock) but may also increase a textured area on the buttons 156 for user-interfacing. In some embodiments, other fasteners may be utilized in place of the hidden set screw. For instance, a snap pin could be inserted through aperture 154-*a* and the aperture 154-*b* in the shaft 157. A rivet, push pin, or spring pin are just a few other non-limiting examples of fasteners that could replace the hidden set screw.

In some cases, the at least one button 156 may be configured to enable release of a magazine from a magazine well of the takedown firearm 100 when depressed. In some examples, the at least one button 156 may be configured to remain flush with a side profile of the buttstock assembly 102 even after repeated use, which may allow the at least one button 156 to be prevented from rotating within a respective cutout or opening on the side of the buttstock assembly 102. Further, the one or more keying features (i.e., the mating of the rectangular end 159 with the recess 181, and/or the hidden fastener through apertures 154-*a* and 154-*b*) described above, may also facilitate in minimizing the rotation of the buttons 156-*a* and/or 156-*b* with respect to each other.

Figure 11:
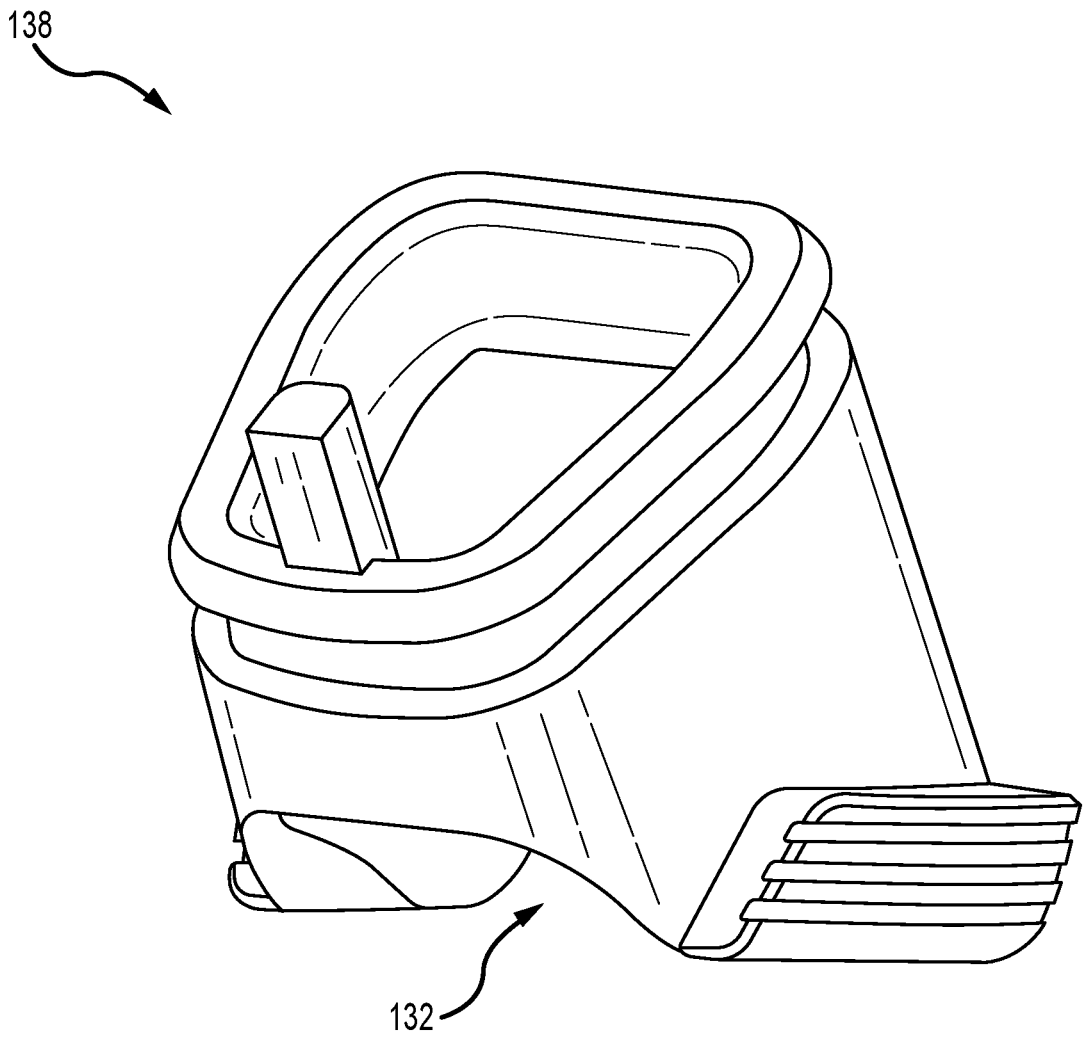
FIG. 11 is a perspective view of the grip insert.

FIG. 11 is a perspective view of the grip insert 138. In some cases, FIG. 11 may implement one or more aspects of the figures described herein, including at least FIGS. 1-6. In some embodiments, the grip insert 138 may comprise a grip locking tab 171 and a cantilever 172 (see FIG. 6). In some embodiments, the cantilever holding the grip locking tab may be angled slightly relative to a top surface of the grip insert 138. In some cases, this angle may provide a molded-in preload to retain the grip insert within the grip 118.

Figure 12:
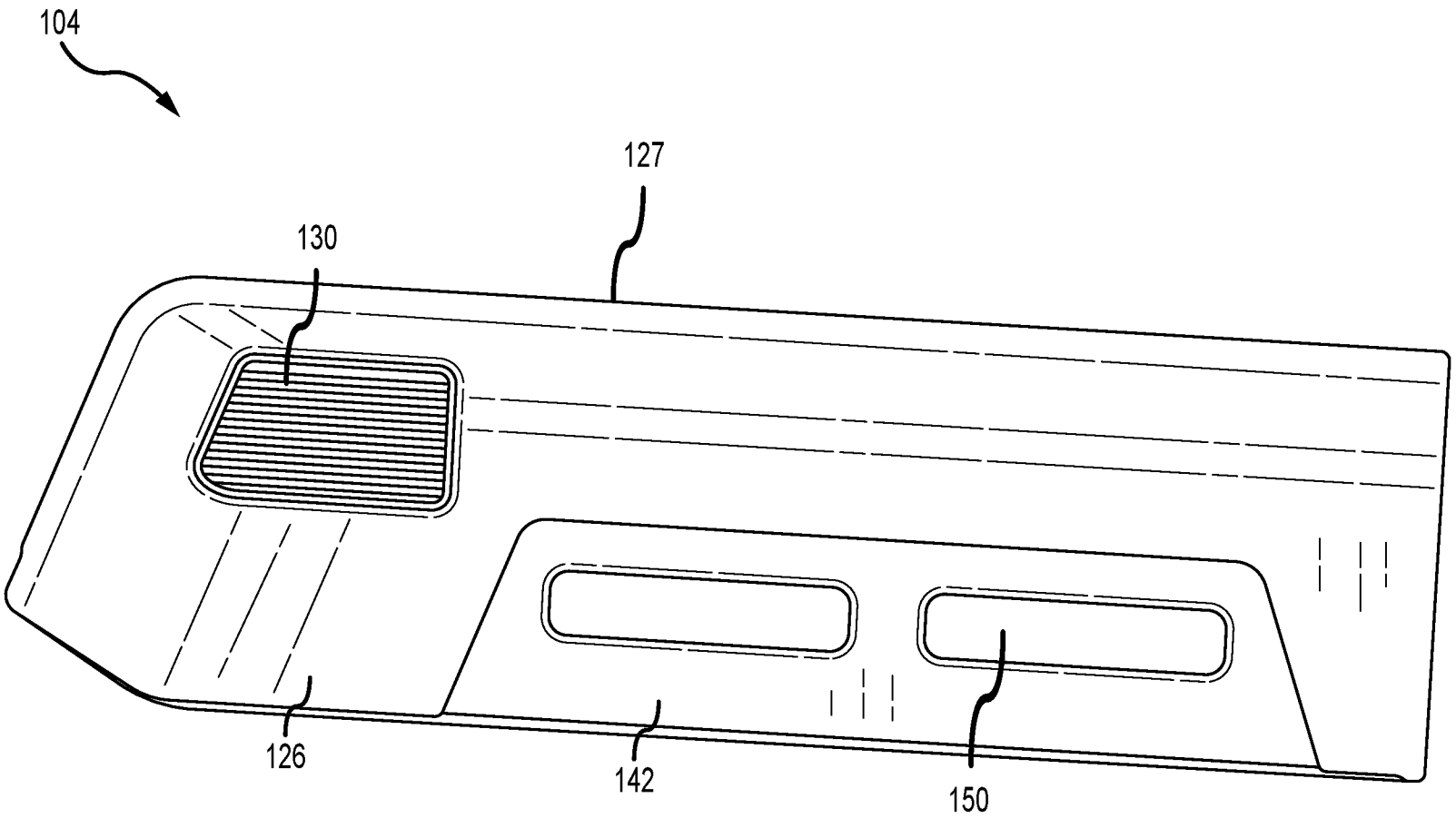
FIG. 12 is a side view of the forend assembly and the barrel tray in FIGS. 2 and/or 3.

FIG. 12 is a side view of the forend assembly 104 comprising the forend 126, the release mechanism comprising one or more buttons 130, and the barrel tray 142. The forend 126 may comprise a forend shell 127 with one or more cutouts or recesses for the buttons 130. In some examples, the forend shell 127 may also surround one or more sides of the barrel tray 142. As previously described, the barrel tray 142 may be configured to couple to the forend 126 of the forend assembly 104 using an attachment mechanism comprising one or more fasteners (e.g., fasteners 152 in FIG. 9). Alternatively, the barrel tray 142 may be coupled to the forend upon application of pressure, for instance, using a snap-fit type mechanism. As seen, the barrel tray 142 may be unitary with or coupled to a first accessory mounting interface 141 comprising one or more elongated slots 150.

Figure 13:
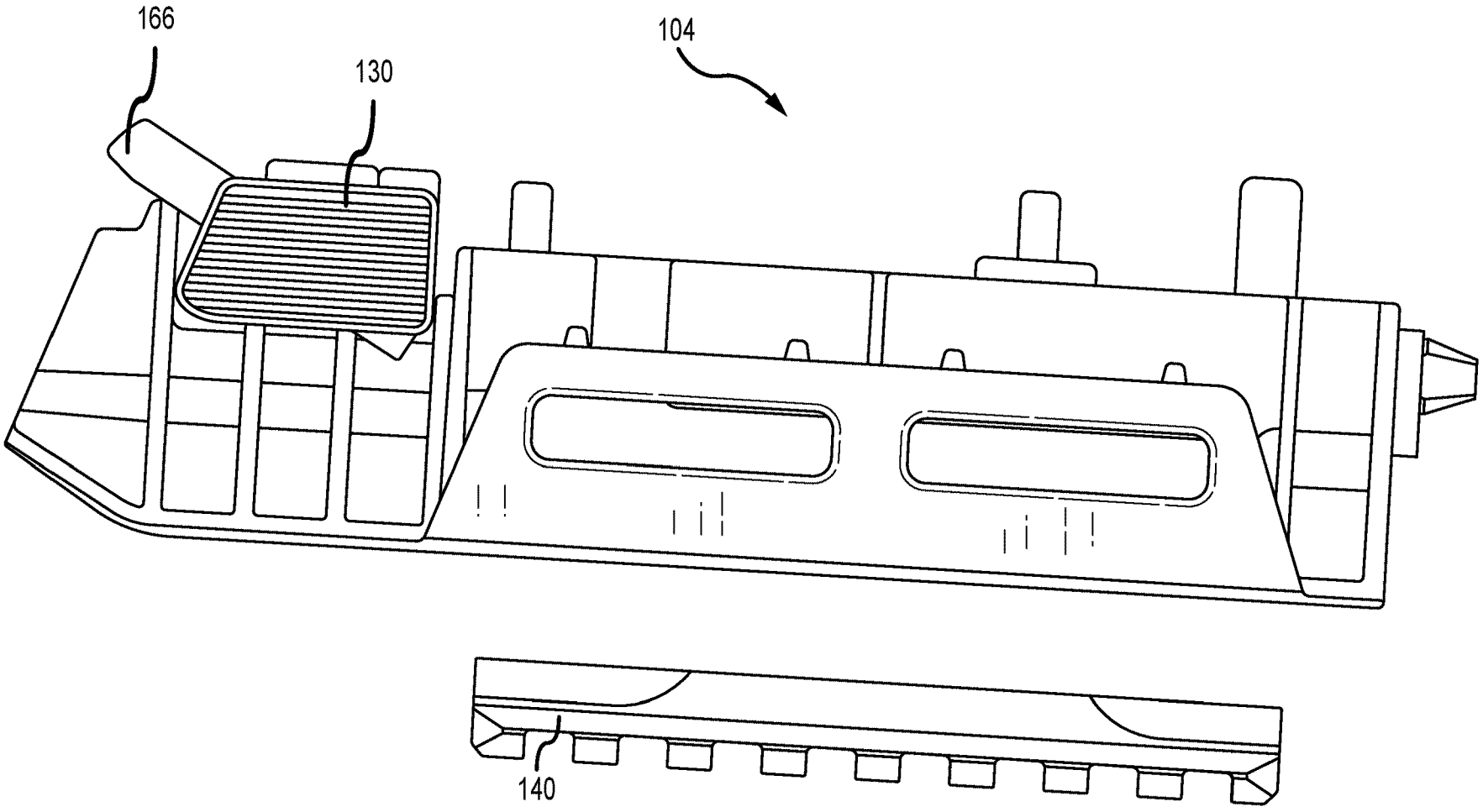
FIG. 13 is an exploded side view of the barrel tray, the release mechanism, and the optional optical mount in FIGS. 2 and/or 3.

FIG. 13 is an exploded side view of the forend assembly 104 illustrating the barrel tray 142 without the barrel, the release mechanism comprising one or more buttons 130, and the optional optical mount 140 in FIG. 2. It should be noted that FIG. 13 does not include the forend shell 127 previously seen in FIG. 12, so as to expose an inside of the forend 126. In some examples, FIG. 13 implements one or more aspects of the figures described herein, including at least FIGS. 1, 2, 6, and 12. In some embodiments, the forend may comprise a latching detent (e.g., latching detent 165 in FIG. 15), where the latching detent further comprises a flange 166. In some examples, the buttons 130 may include interior angled surfaces (e.g., angled surfaces 131) configured to interface with angled surfaces 167 (see especially FIG. 15) of the latching detent 165, such that when the buttons 130 are depressed inward, the latching detent 165 is forced backward to disengage flange 166 from the notch 151 in the buttstock assembly 102.

FIG. 14 is a detailed view of the barrel tray 142 without the barrel, the release mechanism comprising one or more buttons 130, and the latching detent 165 comprising flange 166 in FIG. 13, with the forend shell 127 removed. As seen, the barrel tray 142 comprises a barrel channel 146 unitary with or directly coupled to an accessory mounting interface 141, where the barrel channel may be configured to receive and interface with a barrel (not shown). The accessory mounting interface 141, which may be located on one or more sides of the forend, may also include one or more elongated slots 150 that may be accessible from one or more sides of the forend.

FIG. 15 exposes an inside of the forend assembly 104. As seen, the forend may include a forend shell 127, a release mechanism (e.g., buttons 130), and the latching detent 165. In some embodiments, the latching detent 165 or the flange 166 of the latching detent may extend through an aperture 163 in the forend, where the latching detent (or the flange) may reside at least partially within a recess or valley in the front of the forend. In some cases, the forend may also be removably coupled to the barrel tray 142. In some cases, the buttons 130 may include interior angled surfaces 131 configured to interface with angled surfaces 167 of the latching detent 165, such that when the buttons 130 are depressed inward, the latching detent 165 is forced backward to disengage a forward portion (e.g., flange 166) of the latching detent from the tab (shown as tab 151 in FIG. 1). In some cases, when the buttons 130 are depressed, the latching detent 165 may be forced backwards into a released position. Further, when the buttons 130 are in a relaxed or non-depressed position, the latching detent 165 may be in a relaxed and forward position (e.g., a latched position). In this way, when the latching detent 165 retracts from the latched position relative to the tab 151, it releases the forend assembly 104 from the buttstock assembly 102. In some examples, the buttons 130 may include channels 160 shaped to guide travel of the latching detent 165. Further, the interior angled surfaces 131 may be arranged within these channels 160. In some embodiments, the latching detent 165 may also include one or more springs 168 that bias the latching detent 165 forward to cause part of the flange 166 to extend out of the aperture 163 in the forend shell 127. In some cases, the buttons can include fingers 164 that interlace and help the buttons 130 to remain aligned while moving toward and away from each other.

Figure 16:
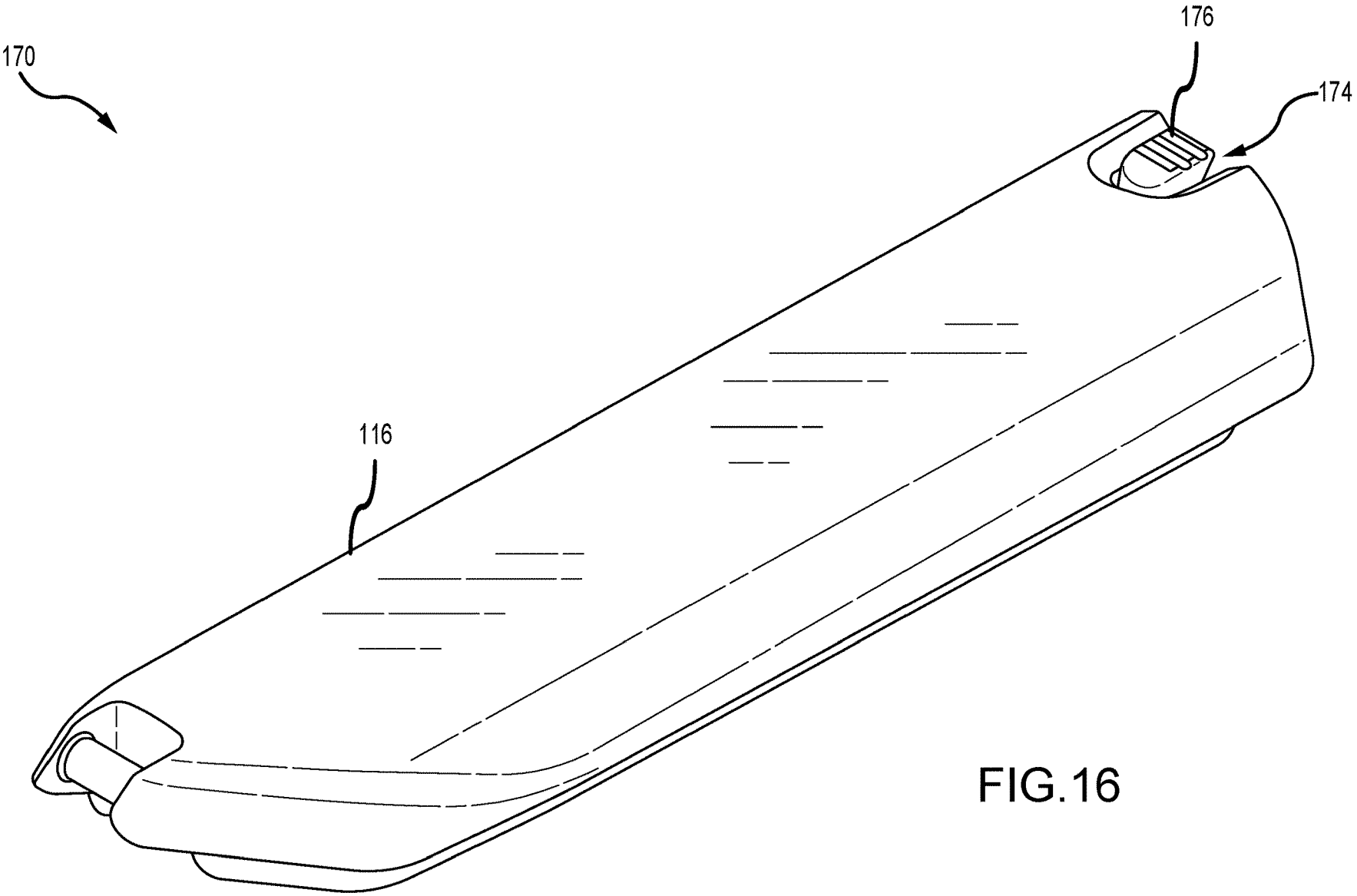
FIG. 16 is a top perspective view of an embodiment of a storage compartment with cheekpieces suitable for use with the assembly in FIG. 1.
Figure 18:
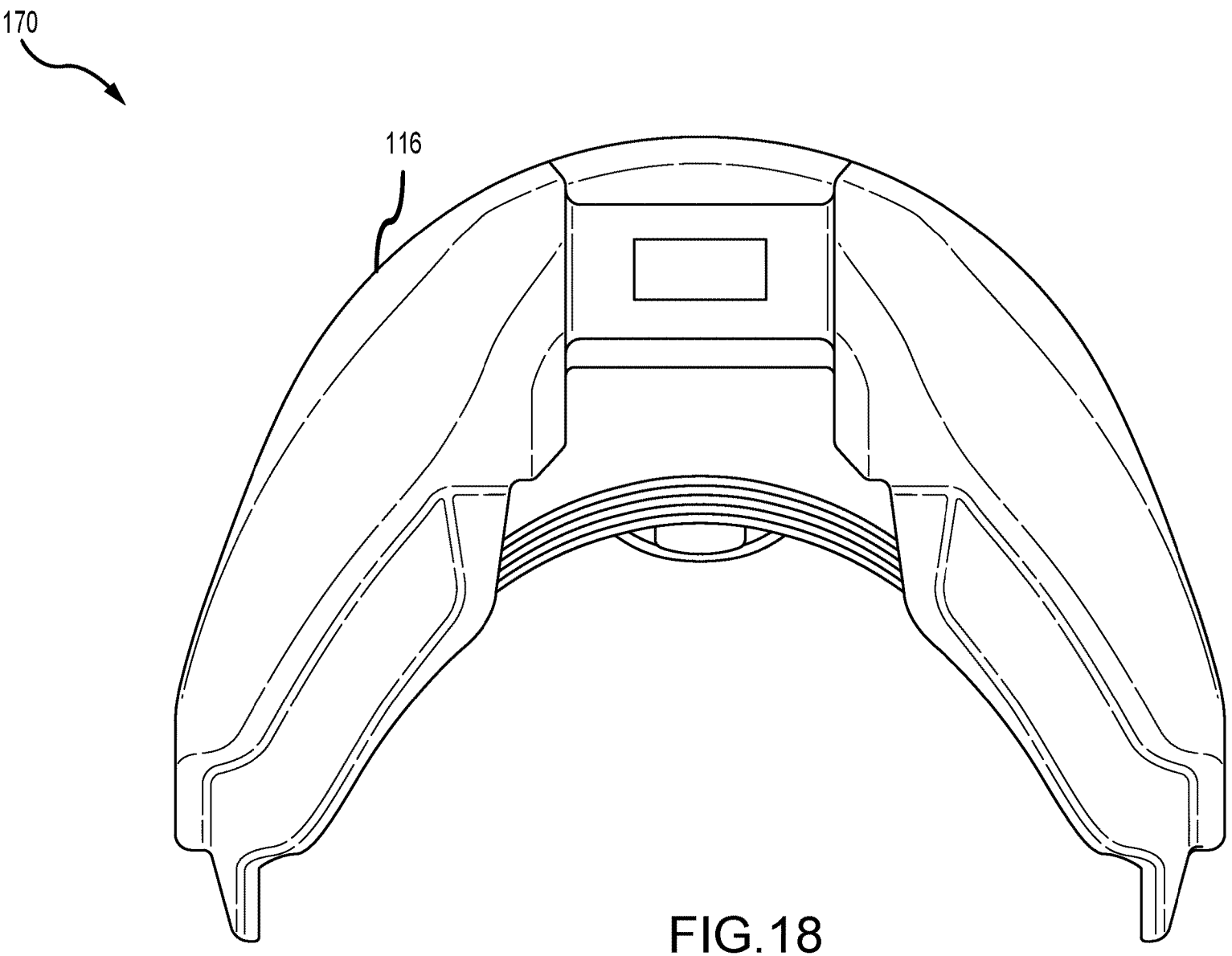
FIG. 18 is a front view of a storage compartment door in FIG. 16.
Figure 19:
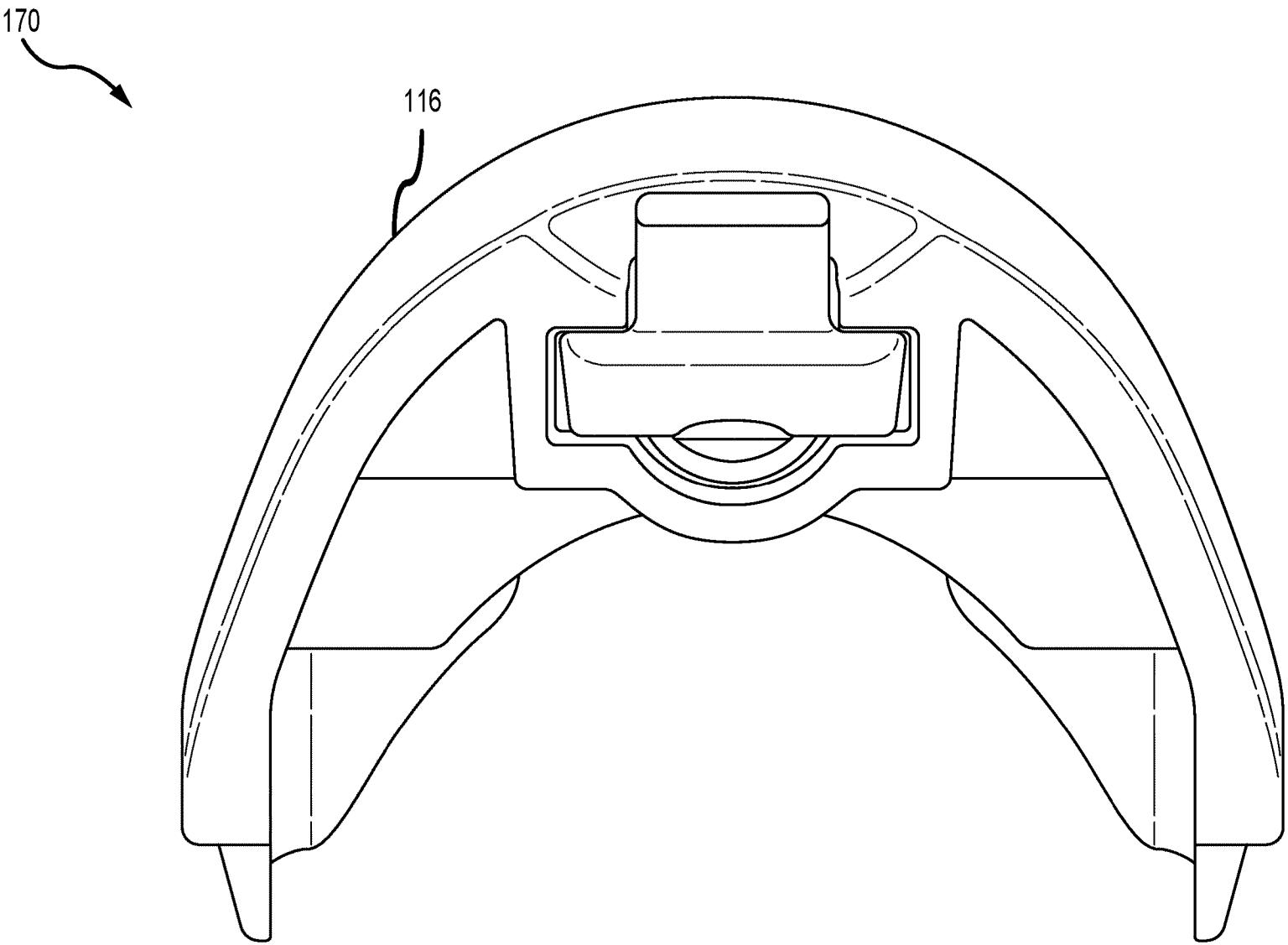
FIG. 19 is a rear view of a storage compartment door in FIG. 16.
Figure 20:
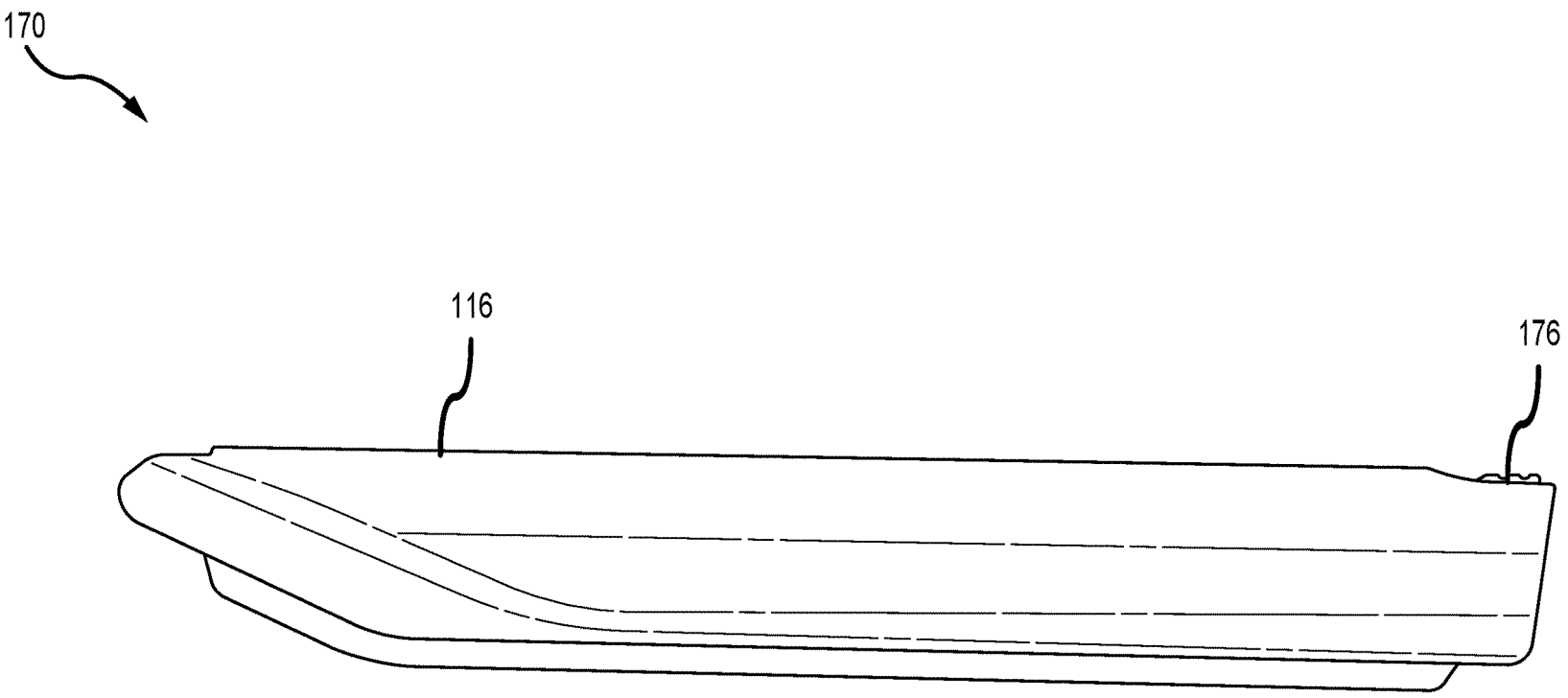
FIG. 20 is a side view of the storage compartment in FIG. 16.

FIG. 16 is a top perspective view of a storage compartment 170 with cheekpieces 116 suitable for use with the assembly in FIG. 1. FIGS. 18, 19, and 20 illustrate a front view, a rear view, and a side view, respectively, of the storage compartment in FIG. 16. In some cases, a storage compartment door formed using the one or more cheekpieces 116 may cover the stock storage compartment 170 in the buttstock assembly 102. In some cases, the stock storage compartment 170 may be built into the buttstock assembly 102 of the firearm 100, for instance, to serve as a magazine/cartridge storage. In some embodiments, the storage compartment door may include a single large removable cheekpiece 116 or two independently removable cheekpieces 116.

In some cases, the stock storage compartment 170 may comprise individual storage compartments, such that each magazine may have its own compartment. In some examples, the cheek piece(s) 116 of the storage compartment door may be configured to make a sealed or water resistant or water tight seal relative to the rest of the buttstock assembly 102, although those skilled in the art will recognize this is an optional feature. In some aspects, locating the storage compartment 170 on a top of the buttstock assembly 102 may ease access to stored items for a user. Also, by orienting the storage vertically, each of the sub compartments within the stock storage compartment 170 can be individually accessed without disrupting the other sub compartments and items stored therein. In some embodiments, separator walls (not shown) may be arranged between each sub compartment, where the separator walls may be removable. In this way, multiple individual storage compartments can be turned into one medium sized storage and one smaller compartment, or alternatively, a single large compartment with removal of one or more of the separator walls. In some embodiments, more than three sub compartments may be formed, and hence more than two separator walls may be implemented. Additionally or alternatively, in some embodiments, one or more of the separator walls can be fixed rather than removable.

Figure 17:
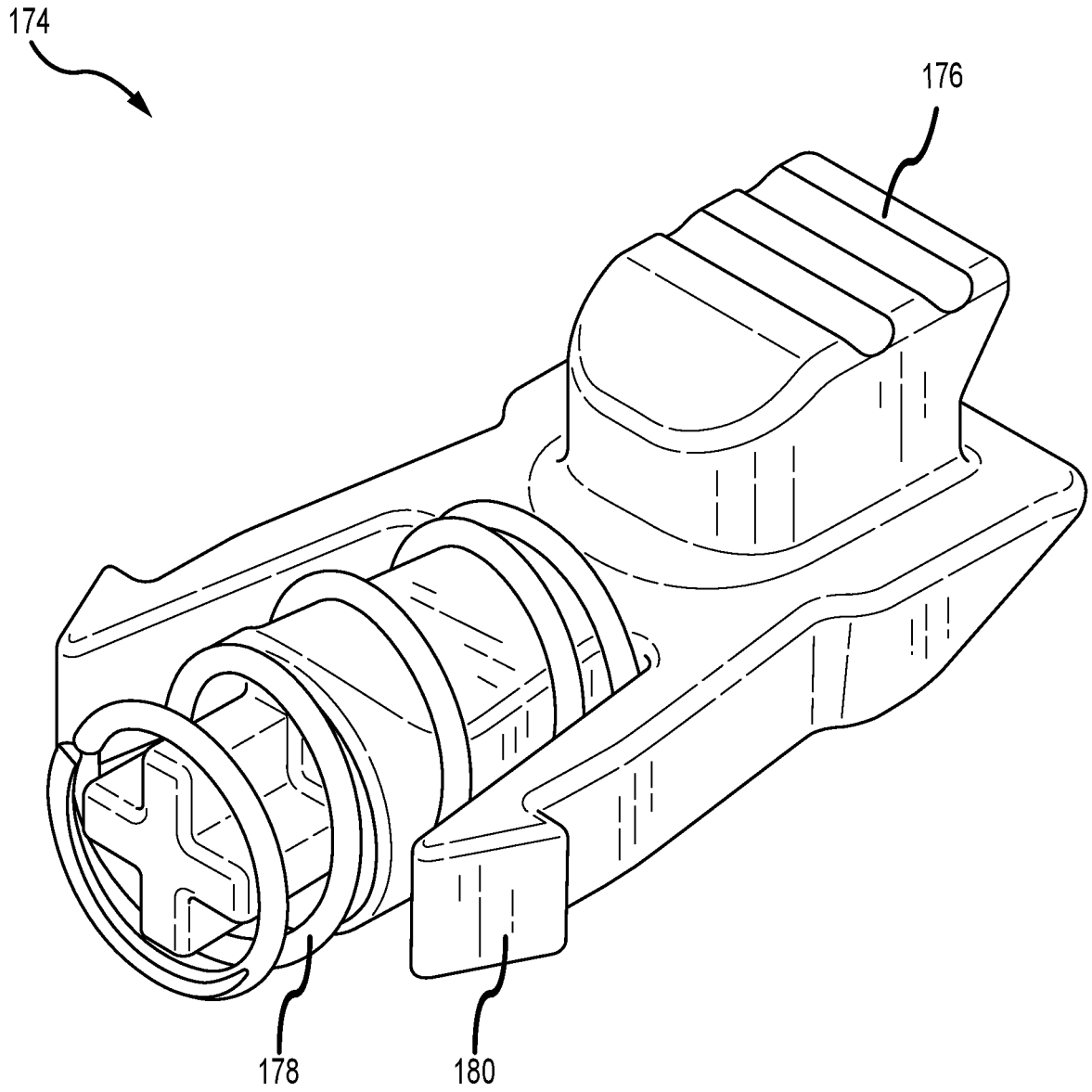
FIG. 17 is a detailed view of an embodiment of a release mechanism for coupling the storage compartment to the buttstock assembly in FIG. 16.

In some cases, the storage compartment door comprising the cheekpieces may be releasably attached to the buttstock assembly 102 via an attachment assembly 174, as further described in relation to FIG. 17.

FIG. 17 illustrates aspects of an attachment assembly 174 that releasably attaches the cheek pieces 116 of the storage compartment door to the buttstock assembly 102. In some cases, the attachment assembly 174 may comprise a button 176, a spring 178, and one or more flanges 180 of a latching mechanism. The button 176 may protrude from near a rear end of the storage compartment door (as shown in FIG. 16) and may be unitary with or coupled to the latching mechanism. Depressing the button 176 may release a coupling between the buttstock assembly 102 and the storage compartment door (or the cheekpieces 116).

Additional Embodiments

A takedown firearm may include a stock assembly having (a) a buttstock assembly; and (b) a forend assembly removably couplable to the buttstock assembly at a first location and a second location; wherein when the forend assembly is coupled to the buttstock at the first location, the forend assembly is positioned to support a barrel of the firearm in a longitudinal firing position; and when the forend assembly is coupled to the buttstock at the second location, the forend assembly is positioned to support the barrel at an angle relative to the longitudinal firing position. The takedown firearm may include a barrel removably coupled to the forend, the barrel having a barrel shank, the barrel shank configured to engage an aperture in the buttstock assembly when the forend assembly is coupled to the buttstock at the second location. In some cases, the forend assembly is coupled to the buttstock assembly at two or more attachment points when the forend is coupled to the buttstock assembly at the second location. In some cases, the buttstock assembly may also comprise a passage for supporting the barrel.

In some cases, the stock assembly further comprises a release mechanism for coupling the buttstock assembly and the forend assembly, wherein the release mechanism comprises at least one of a detent engagement between the buttstock assembly and the forend assembly or a lever engagement between the buttstock assembly and the forend assembly. In some cases, the release mechanism comprises a button and a detent engagement, the button configured to release the detent engagement when depressed. In some cases, the release mechanism comprises a plurality of buttons and a detent engagement, the buttons configured to release the detent engagement when depressed. In some cases, the forend assembly comprises a recess for receiving a barrel of the firearm; and the buttstock assembly comprises a grip and a recess for providing a clearance for the barrel, where the grip comprises a grip insert for receiving the barrel. In some cases, the buttstock assembly further comprises a storage compartment, the storage compartment having a detachable cheekpiece forming a top portion of the storage compartment, and a release mechanism for enabling detachment of the cheekpiece. In some cases, a removable separator wall may be positioned inside the storage compartment, where the separator wall may be shaped to divide the storage compartment into a plurality of sub-compartments. In some cases, the storage compartment is further shaped and configured to store a firearm magazine in a vertical orientation. Further, the release mechanism for enabling detachment of the cheekpiece may comprise a detent engagement between the cheekpiece and another wall of the storage compartment.

In some cases, the method may include providing a stock assembly for a takedown firearm, the stock assembly having a buttstock assembly, and a forend assembly removably couplable to the buttstock assembly at a first location and a second location. The method may include coupling the forend assembly to the buttstock at the first location, wherein the forend assembly is positioned to support a barrel of the firearm in a longitudinal firing position. The method may include coupling the forend assembly to the buttstock at the second location, wherein the forend assembly is positioned to support the barrel at an angle relative to the longitudinal firing position.

The method may include operating a release mechanism to detach the forend from the second location on the buttstock assembly. The method may include storing a firearm magazine in a vertical orientation in the buttstock assembly. The method may include nesting the forend assembly in a storage cavity of the buttstock assembly.

In some cases, the method may also include making a firearm support system, by forming a firearm barrel channel and a firearm accessory mounting interface from a first high-strength material. In some cases, forming may include forming of a high-strength engineering grade polymer and/or reinforced composite materials.

Additionally or alternatively, the method may include forming a firearm stock from a second lower-strength material. In some cases, forming may include forming of a lower cost engineering polymer or a commodity plastic. Forming may include forming of a material that is not as strong as a material used to form the firearm barrel channel and firearm accessory mounting interface. In some examples, the method may further include coupling the firearm barrel channel and firearm accessory mounting interface to an interior portion of the firearm stock such that the firearm barrel channel sits on a top side of the forend or the stock and the firearm accessory mounting interface is accessible from one or more sides of the forend or the stock. In some cases, the accessory mounting interface is configured to be attached to and in contact with only a bottom portion of the firearm stock. In some cases, the accessory mounting interface is substantially flush with a profile of the firearm stock. Additionally or alternatively, the accessory mounting interface aligns with a recess in one or more sides of the forend or the stock.

In some embodiments, a firearm barrel tray having a barrel channel and a firearm accessory mounting interface may be configured to be attached to a firearm stock such that the barrel channel sits on a first side of the firearm stock. Further, the firearm accessory mounting interface may be configured to align with a recess on a second side of the firearm stock. In some cases, the firearm barrel tray may further comprise reinforcing ribs on a supporting wall of the tray between the barrel channel and the accessory mounting interface. In some cases, the firearm barrel tray may be configured to be fastened to the firearm stock via fasteners located in an interior portion of the stock, or alternatively, a forend.

The word "exemplary" is used herein to mean "serving as an example, instance, or illustration." Any embodiment described herein as "exemplary" is not necessarily to be construed as preferred or advantageous over other embodiments.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A takedown firearm stock, comprising:
- a buttstock assembly comprising a magazine release;
- a first accessory mounting interface;
- a forend assembly comprising a recess for receiving a barrel having a barrel shank, and wherein the forend assembly further comprises:
  - a release mechanism for removably coupling the forend assembly and the buttstock assembly, and one of:
  - an attachment bracket configured to support the barrel, the attachment bracket comprising the first accessory mounting interface, or
  - a barrel tray removably coupled to the forend assembly, the barrel tray comprising a barrel channel configured to receive and interface with the barrel, wherein the barrel channel is unitary with or coupled to the first accessory mounting interface;

wherein
- when the forend assembly is coupled to the buttstock assembly in a deployed configuration, the forend assembly releasably couples to the buttstock assembly at a forend-to-stock interface, and the barrel shank couples to a receiver of the takedown firearm, and
- when the forend assembly is coupled to the buttstock assembly in a stowed configuration, the forend assembly releasably couples to an underside of the buttstock assembly.

2. The takedown firearm stock of claim 1, wherein the buttstock assembly further comprises a grip and a recess for providing a clearance for the barrel, and an aperture shaped to partially enclose and protect the barrel shank of the barrel,
- and when the forend assembly is coupled to the buttstock assembly in the deployed configuration, the forend assembly is positioned to support the barrel in a longitudinal firing position,
- and when the forend assembly is coupled to the buttstock assembly in the stowed configuration, the aperture of the buttstock assembly is shaped to partially enclose and protect the barrel shank, and the forend assembly is positioned to nest in a storage cavity on the underside of the buttstock assembly.

3. The takedown firearm stock of claim 1, wherein the barrel tray is configured to couple to the forend assembly upon application of pressure, or wherein the barrel tray is coupled to the forend assembly using an attachment mechanism comprising one or more fasteners.

4. The takedown firearm stock of claim 1, wherein the first accessory mounting interface comprises one or more elongated slots configured to receive one or more mounting rails for mounting one or more accessories, or configured to receive one or more accessories.

5. The takedown firearm stock of claim 1, wherein at least one of a weight density, a strength, or a rigidity or stiffness of a material used to form the first accessory mounting interface is greater than that of a material used to form a respective one of the forend assembly or the buttstock assembly.

6. The takedown firearm stock of claim 1, wherein the barrel channel comprises one or more cutouts shaped and positioned to allow air flow through one or more elongated slots of the first accessory mounting interface.

7. The takedown firearm stock of claim 1, wherein the magazine release comprises a shaft, a fastener arranged perpendicular to and passing through the shaft, and a first button configured to be installed within a first cutout on a first side of the buttstock assembly, wherein the first button is configured to enable release of a magazine from a magazine well of the takedown firearm when depressed.

8. The takedown firearm stock of claim 7, wherein the shaft comprises a keying feature to: prevent rotation of the first button within the first cutout on the first side of the stock assembly, prevent rotation of the first button with respect to a second button, the second button configured to be installed within a second cutout on a second opposing side of the buttstock assembly, or a combination thereof.

9. The takedown firearm stock of claim 8, wherein the first button is unitary with or coupled to the shaft, and wherein the keying feature comprises a flat section having a rectangular end on the shaft, the rectangular end configured to mate with a recess in the second button, and wherein the fastener passes through one or more of an aperture in the second button and an aperture in the rectangular end.

10. The takedown firearm stock of claim 1, wherein the forend assembly further comprises one or more accessory recesses shaped to accept at least the first accessory mounting interface, and wherein one or more second accessory mounting interfaces partially extend through the one or more accessory recesses, the one or more second accessory mounting interfaces accessible from one or more sides of the forend assembly.

11. The takedown firearm stock of claim 1, wherein at least a portion of the first accessory mounting interface protrudes through an accessory recess in the forend assembly and is configured to receive one or more mounting rails for mounting one or more accessories, or configured to receive one or more accessories.

12. The takedown firearm stock of claim 1, wherein the barrel tray comprises one or more reinforcing ribs shaped and positioned on a supporting wall of the barrel tray, wherein the supporting wall connects the barrel channel to the first accessory mounting interface.

13. A method, comprising:

providing a buttstock assembly, and a forend assembly for a takedown firearm, wherein the forend assembly is removably couplable to the buttstock assembly in a deployed configuration and a stowed configuration;

providing a release mechanism for removably coupling the forend assembly and the buttstock assembly, the release mechanism comprising a release button and a detent engagement, the release button configured to release the detent engagement when depressed;

providing a recess and a barrel tray in the forend assembly for receiving a barrel having a barrel shank, wherein the barrel tray is configured to interface with the barrel;

providing a first accessory mounting interface unitary with or coupled to the barrel tray;

providing a magazine release having a keying feature, and at least one button, wherein the at least one button is configured to enable release of a magazine from a magazine well of the takedown firearm when depressed;

coupling the forend assembly to the buttstock assembly in the deployed configuration, the barrel shank of the barrel configured to couple to a receiver of the takedown firearm; and coupling the forend assembly to the buttstock assembly in the stowed configuration, wherein the forend assembly is coupled to an underside of the buttstock assembly.

14. A takedown firearm, comprising:

an action assembly;

a barrel having a barrel shank;

a magazine release;

a buttstock assembly;

a first accessory mounting interface;

a forend assembly comprising a recess for receiving the barrel, and wherein the forend assembly further comprises:

a release mechanism for removably coupling the forend assembly and the buttstock assembly, and one of:

an attachment bracket configured to support the barrel, the attachment bracket comprising the first accessory mounting interface, or a barrel tray removably coupled to the forend assembly, the barrel tray comprising a barrel channel configured to receive and interface with the barrel, wherein the barrel channel is unitary with or coupled to the first accessory mounting interface; wherein when the forend assembly is coupled to the buttstock assembly in a deployed configuration, the forend assembly releasably couples to the buttstock assembly at a forend-to-stock interface, and the barrel shank is configured to couple to the action assembly, and when the forend assembly is coupled to the buttstock assembly in a stowed configuration, the forend assembly releasably couples to an underside of the buttstock assembly.

15. The takedown firearm of claim 14, wherein the first accessory mounting interface comprises one or more elongated slots configured to receive one or more mounting rails for mounting one or more accessories, or configured to receive one or more accessories.

16. The takedown firearm of claim 14, wherein at least one of a weight density, a strength, or a rigidity of a material used to form the first accessory mounting interface is greater than that of a material used to form the forend assembly or the buttstock assembly.

17. The takedown firearm of claim 14, wherein the magazine release comprises:

at least one button configured to be installed within a cutout on a side of the buttstock assembly, wherein the at least one button is configured to release a magazine from a magazine well of the firearm when depressed;

a shaft having a keying feature to prevent rotation of the at least one button within the cutout on the side of the buttstock assembly, the keying feature comprising a flat section; and a fastener arranged perpendicular to and passing through the shaft.

18. The takedown firearm of claim 14, wherein at least a portion of the first accessory mounting interface is shaped and positioned to protrude through an accessory recess in the forend assembly and is configured to receive one or more mounting rails for mounting one or more accessories, or configured to receive one or more accessories.

19. The takedown firearm of claim 14, wherein the barrel tray comprises one or more reinforcing ribs shaped and positioned on a supporting wall of the barrel tray, wherein the supporting wall is arranged to connect the barrel channel to the first accessory mounting interface.

20. The takedown firearm of claim 14, wherein the forend assembly further comprises one or more accessory recesses, and wherein one or more second accessory mounting interfaces partially extend through the one or more accessory recesses, the one or more second accessory mounting interfaces accessible from one or more sides of the forend assembly.

* * * * *